US011742140B2

(12) United States Patent
Mizumura et al.

(10) Patent No.: US 11,742,140 B2
(45) Date of Patent: Aug. 29, 2023

(54) WOUND CORE AND METHOD FOR PRODUCING SAME

(71) Applicant: NIPPON STEEL CORPORATION, Tokyo (JP)

(72) Inventors: Takahito Mizumura, Tokyo (JP); Masato Mizokami, Tokyo (JP); Hisashi Mogi, Tokyo (JP); Fumiaki Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/605,961

(22) PCT Filed: Apr. 27, 2020

(86) PCT No.: PCT/JP2020/017956
§ 371 (c)(1),
(2) Date: Oct. 22, 2021

(87) PCT Pub. No.: WO2020/218607
PCT Pub. Date: Oct. 29, 2020

(65) Prior Publication Data

US 2022/0199320 A1 Jun. 23, 2022

(30) Foreign Application Priority Data

Apr. 25, 2019 (JP) ..... 2019-084634

(51) Int. Cl.
*H01F 41/00* (2006.01)
*H01F 41/02* (2006.01)
*H01F 27/245* (2006.01)

(52) U.S. Cl.
CPC ..... *H01F 41/0233* (2013.01); *H01F 27/245* (2013.01)

(58) Field of Classification Search
CPC . H01F 41/0233; H01F 41/024; H01F 27/2455
See application file for complete search history.

(56) References Cited

U.S. PATENT DOCUMENTS 10,886,055 B2 * 1/2021 Mizumura ..... H01F 27/2455
2010/0055481 A1 3/2010 Kubo
(Continued)

FOREIGN PATENT DOCUMENTS

JP 3081863 U 11/2001
JP 2005-286169 A 10/2005
(Continued)

*Primary Examiner* — Paul D Kim
(74) *Attorney, Agent, or Firm* — Birch, Stewart, Kolasch & Birch, LLP

(57) ABSTRACT

Provided is a wound core formed by laminating a plurality of bent bodies obtained by forming a coated grain-oriented electrical steel sheet in which a coating is formed on at least one surface of a grain-oriented electrical steel sheet so that the coating is on an outside, in a sheet thickness direction, in which the bent body has a bent region obtained by bending the coated grain-oriented electrical steel sheet and a flat region adjacent to the bent region, the number of deformation twins present in the bent region in a side view is five or less per 1 mm of a length of a center line in the sheet thickness direction in the bent region, and when a region extending 40 times a sheet thickness to both sides in a circumferential direction from a center of the bent region on an outer circumferential surface of the bent body is defined as a strain affected region, a proportion of an area where the coating is not damaged at any position along the circumferential direction in a flat region within the strain affected region is 90% or more.

10 Claims, 11 Drawing Sheets

(56) References Cited

U.S. PATENT DOCUMENTS

| | | | | |
|---|---|---|---|---|
| 2013/0309525 | A1* | 11/2013 | Fujikura | H01F 1/01 148/507 |
| 2016/0322138 | A1 | 11/2016 | Han et al. | |
| 2017/0240987 | A1 | 8/2017 | Nagoshi et al. | |
| 2020/0126709 | A1 | 4/2020 | Mizumura et al. | |
| 2021/0082606 | A1* | 3/2021 | Mogi | C21D 3/04 |
| 2022/0119907 | A1* | 4/2022 | Arai | C23C 22/74 |

FOREIGN PATENT DOCUMENTS

| | | | |
|---|---|---|---|
| JP | 2016-145419 | A | 8/2016 |
| JP | 2017-508889 | A | 3/2017 |
| JP | 2017-157806 | A | 9/2017 |
| JP | 2018-148036 | A | 9/2018 |
| WO | WO 2008/062853 | A1 | 5/2008 |
| WO | WO 2016/047077 | A1 | 3/2016 |
| WO | WO 2018/131613 | A1 | 7/2018 |

* cited by examiner

| AVERAGE CORE LENGTH(m) | CORE WEIGHT (kg) | VOLUME (KVA) |
|---|---|---|
| 0.704 | ABOUT 37 | 25 |

WOUND CORE AND METHOD FOR PRODUCING SAME

TECHNICAL FIELD OF THE INVENTION

The present disclosure relates to a wound core and a manufacturing method of the wound core.

Priority is claimed on Japanese Patent Application No. 2019-084634, filed Apr. 25, 2019, the content of which is incorporated herein by reference.

RELATED ART

Wound cores are widely used as magnetic cores for transformers, reactors, noise filters, or the like. A reduction in iron loss caused in an iron core is hitherto one of the important tasks from a viewpoint of high efficiency and the like, and examinations have been conducted to reduce iron loss from various viewpoints.

As one of manufacturing methods of a wound core, for example, a method disclosed in Patent Document 1 is widely known. In this method, after winding a steel sheet into a tubular shape, the steel sheet is pressed so that corner portions have a constant curvature, and the steel sheet is formed into a substantially rectangular shape. Thereafter, a strain relief of the steel sheet and shape retention of the steel sheet are performed by annealing the steel sheet. In the case of this manufacturing method, a radius of curvature of the corner portion differs depending on a dimension of a wound core. However, the radius of curvature is approximately 4 mm or more, and the corner portion is a gentle curved surface having a relatively large radius of curvature.

On the other hand, as another manufacturing method of a wound core, the following method of laminating steel sheets to form a wound core has been examined. In the method, parts of steel sheets which are to become corner portions of the wound core are previously bent, and the bent steel sheets are overlapped.

According to the manufacturing method, the pressing step is unnecessary. In addition, since the steel sheet is bent, the shape is retained and shape retention by the annealing step is not an essential step. Therefore, there is an advantage that manufacturing is facilitated. In the manufacturing method, since the steel sheet is bent, a bent region having a radius of curvature of 3 mm or less, that is, a bent region having a relatively small radius of curvature is formed in the processed part.

As a wound core manufactured by a manufacturing method including bending, for example, Patent Document 2 discloses the following structure of the wound core. The wound core is formed by overlapping a plurality of steel sheets having different lengths that are bent in an annular shape in an outer peripheral direction. The facing end surfaces of each of the steel sheets are evenly displaced by a predetermined dimension in a lamination direction of the plurality of steel sheets, and the joint portions of the end surfaces are stepped.

Patent Document 3 discloses the following manufacturing method of a wound core. In the manufacturing method, a coated grain-oriented electrical steel sheet having a coating containing phosphorus formed on a surface is bent into a bent body, and a plurality of bent bodies are laminated in a sheet thickness direction to manufacture a wound core. When the coated grain-oriented electrical steel sheet is bent, the coated grain-oriented electrical steel sheet is bent in a state where a portion of the bent body to be a bent region is 150° C. or higher and 500° C. or lower. The obtained plurality of bent bodies are laminated in the sheet thickness direction. According to this method, the number of deformation twins present in the bent region of the bent body is suppressed, and a wound core in which iron loss is suppressed is obtained.

PRIOR ART DOCUMENT

Patent Document

[Patent Document 1] Japanese Unexamined Patent Application, First Publication No. 2005-286169

[Patent Document 2] Japanese Utility Model (Registered) Publication No. 3081863

[Patent Document 3] PCT International Publication No. WO 2018/131613

DISCLOSURE OF THE INVENTION

Problems to be Solved by the Invention

An object of the present disclosure is to provide a wound core in which iron loss is suppressed, and a manufacturing method of the wound core.

Means for Solving the Problem

The present disclosure is summarized as follows.

<1> A wound core formed by laminating a plurality of bent bodies obtained by forming a coated grain-oriented electrical steel sheet in which a coating is formed on at least one surface of a grain-oriented electrical steel sheet so that the coating is on an outside, in a sheet thickness direction, in which the bent body has a bent region obtained by bending the coated grain-oriented electrical steel sheet and a flat region adjacent to the bent region, the number of deformation twins present in the bent region in a side view is five or less per 1 mm of a length of a center line in the sheet thickness direction in the bent region, and when a region extending 40 times a sheet thickness of the coated grain-oriented electrical steel sheet to both sides in a circumferential direction from a center of the bent region on an outer circumferential surface of the bent body is defined as a strain affected region, a proportion of an area where the coating is not damaged at any position along the circumferential direction in a flat region within the strain affected region is 90% or more.

<2> The wound core according to <1>, in which, when a plurality of minute regions divided by 0.5 mm along the circumferential direction are defined as the strain affected region, the proportion in each of the plurality of minute regions in each of the plurality of bent bodies is defined as a basic local soundness rate, and an average value of the basic local soundness rates in each of the minute regions at the same position in the circumferential direction in different bent bodies is defined as an average local soundness rate, the average local soundness rate is 90% or more in all the minute regions having different positions in the circumferential direction, and all the basic local soundness rates are 50% or more.

<3> A manufacturing method of a wound core for manufacturing the wound core according to <1> or <2>, including:

a steel sheet preparation step of preparing the coated grain-oriented electrical steel sheet;

a bending step of bending the coated grain-oriented electrical steel sheet to form the bent body under conditions that a portion of the bent body to be the bent region is heated to 45° C. or higher and 500° C. or lower, and in the flat region within the strain affected region, an absolute value of a local temperature gradient at any position in a longitudinal direction of the coated grain-oriented electrical steel sheet is less than 400° C./mm; and a lamination step of laminating the plurality of the bent bodies in a sheet thickness direction.

<4> The manufacturing method of a wound core according to <3>, in which, in the bending step, the bending is performed under a condition that a product of the sheet thickness of the coated grain-oriented electrical steel sheet and an absolute value of the local temperature gradient is less than 100° C.

<5> The manufacturing method of a wound core according to <3> or <4>, including a steel sheet heating step of heating the coated grain-oriented electrical steel sheet after the steel sheet preparation step and before the bending step.

<6> A wound core manufacturing apparatus used for executing the manufacturing method of a wound core according to <5>, including:

a heating device that heats the coated grain-oriented electrical steel sheet; and a bending device that bends the coated grain-oriented electrical steel sheet conveyed from the heating device.

<7> The wound core manufacturing apparatus according to <6>, in which the coated grain-oriented electrical steel sheet unwound from a coil is conveyed to the heating device, and the bending device cuts the coated grain-oriented electrical steel sheet and then bends the coated grain-oriented electrical steel sheet.

<8> The wound core manufacturing apparatus according to <7>, further including a pinch roll that conveys the coated grain-oriented electrical steel sheet to the heating device.

<9> The wound core manufacturing apparatus according to <6>, in which the heating device heats a coil and the coated grain-oriented electrical steel sheet that is unwound from the coil and conveyed to the bending device.

<10> The wound core manufacturing apparatus according to any one of <6> to <9>, in which the heating device heats the coated grain-oriented electrical steel sheet by induction heating or irradiation with high energy rays.

Effects of the Invention

According to the present disclosure, it is possible to provide a wound core in which iron loss is suppressed, and a manufacturing method of the wound core.

EMBODIMENTS OF THE INVENTION

Figure 1:
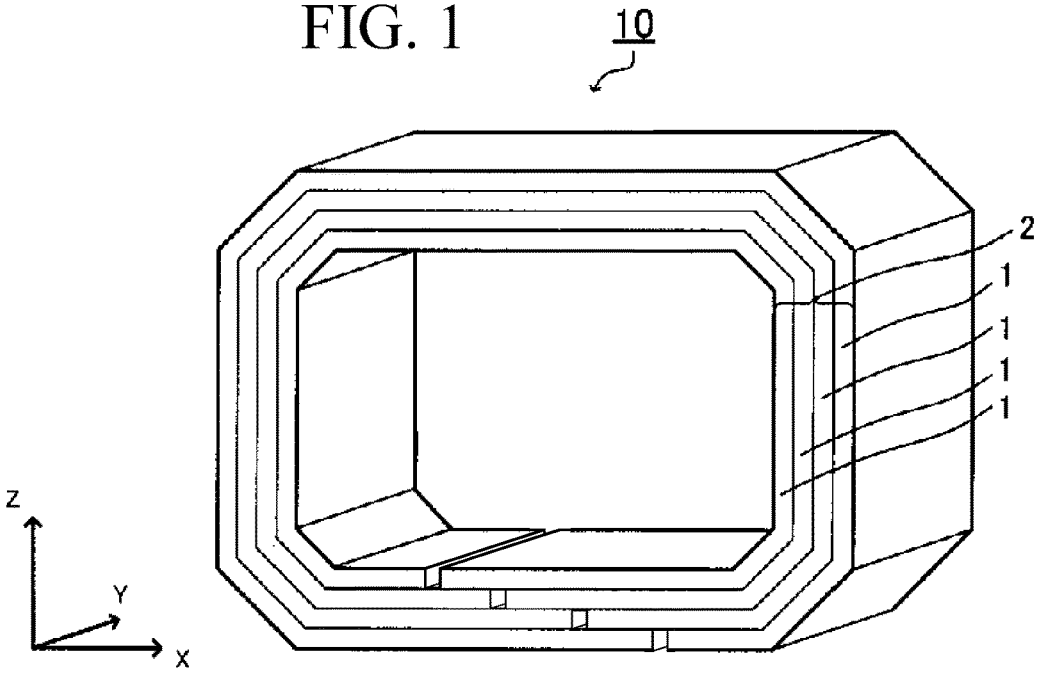
FIG. 1 is a perspective view showing an example of a wound core.

Hereinafter, a wound core and a manufacturing method of the wound core according to the present disclosure will be described.

The terms such as "parallel", "perpendicular", and "same", and values of lengths and angles, and the like that specify shapes, geometrical conditions, and degrees, which are used in the present disclosure, are not bound to strict meanings but are construed as including ranges in which the same functions can be expected. In addition, in the present disclosure, approximately 90° permits an error of ±3°, and means a range of 87° to 93°.

In addition, the content of elements in a composition may be expressed as an elemental amount (for example, C amount, Si amount, and the like).

Further, regarding the contents of elements in a composition, "%" means "mass %".

Further, the term "step" is included in this term as long as the intended purpose of the step is achieved, not only in an independent step but also in cases where it cannot be clearly distinguished from other steps.

Further, a numerical range represented by using "to" means a range including the numerical values described before and after "to" as a lower limit value and an upper limit value.

Prior to the completion of the wound core and the manufacturing method of the wound core according to the present disclosure, some of the present inventors found the following matters (refer to, Patent Document 3).

That is, in the manufacturing method of the wound core according to Patent Document 3, a grain-oriented electrical steel sheet having a coating containing phosphorus formed on a surface is bent into a bent body, and a plurality of bent bodies are laminated to manufacture a wound core. At this time, a portion (in the present disclosure, it may be referred to as a "bent region forming portion") of the bent body to be the bent region by bending the grain-oriented electrical steel sheet is bent in a state where the portion is 150° C. or higher and 500° C. or lower. As a result, the number of deformation twins present in the bent region is suppressed. Iron loss is suppressed by forming such a plurality of bent bodies laminated in the sheet thickness direction.

However, according to a subsequent study, it has been clarified that, even when a temperature of the bent region forming portion is adjusted to 150° C. or higher and 500° C. or lower and the bending is performed, damage of the coating may occur in the vicinity of a boundary between the bent region and the flat region adjacent to the bent region. The damage occurs locally on the flat region side in the vicinity of the boundary. Here, the "damage" is recognized as cracking of the coating (cracking in the coating) when the damage is slight, and is detected as peeling of the coating when the damage is severe. When cracks occur in the coating (when the damage is slight), there are situations where (1) a tip of the crack stays in the coating and does not reach a base steel sheet, and (2) the crack reaches the base steel sheet. When the coating is peeled off (when the damage is severe), there are situations where (1) the coating is completely peeled off to expose the base steel sheet, and (2) only an upper layer region of the coating is peeled off and missing, but a lower layer region covers the base steel sheet. In the present disclosure, these situations are collectively referred to as "damage".

Even when the bent region forming portion is heated to 150° C. or higher and 500° C. or lower as in the method disclosed in Patent Document 3 described above, a temperature gradient occurs in the vicinity of the boundary between the bent region forming portion and the portion that becomes a flat region adjacent to the bent region forming portion (which may be referred to as a "flat region forming portion" in the present disclosure). The temperature gradient changes continuously at a temperature below the heating (equalizing) temperature. It has been clarified that when the temperature gradient is steep, strain is introduced into the flat region forming portion and damage of the coating of the flat region forming portion occurs.

Thus, the present inventors have found that the introduction of strain at the flat region forming portion and the damage of a tension coating are causes of a deterioration of the iron loss.

As a result of further studies to solve the above problems, the present inventors have found the following matters, and have completed the wound core and the manufacturing method of the wound core according to the present disclosure.

When bending the coated grain-oriented electrical steel sheet (which may be referred to as a "coated steel sheet" or simply a "steel sheet" in the present disclosure), the bending is performed by heating so that (1) a temperature of a portion to be the bent region (bent region forming portion) and (2) a temperature gradient of the portion to be the flat region (flat region forming portion) adjacent to the bent region forming portion to be bent are within specific ranges. As a result, (a) generation of deformation twins in the bent region is suppressed, and the deterioration of iron loss in the bent region is avoided. Further, in addition to that merit, (b) peeling of the coating is suppressed even in the flat region adjacent to the bent region. Moreover, (c) a bent body with less strain in the processed portion can be obtained. The present inventors have found that a wound core in which iron loss is suppressed can be obtained by laminating a plurality of bent bodies thus manufactured so that each of the steel sheets of the bent bodies overlap each other.

[Wound Core]

A wound core according to the present disclosure is a wound core formed by laminating a plurality of bent bodies obtained by forming a coated grain-oriented electrical steel sheet in which a coating is formed on at least one surface of a grain-oriented electrical steel sheet so that the coating is on an outside, in a sheet thickness direction, in which the bent body has a bent region obtained by bending the coated grain-oriented electrical steel sheet and a flat region adjacent to the bent region, the number of deformation twins present in the bent region in a side view is five or less per 1 mm of a length of a center line in the sheet thickness direction in the bent region, and when a region extending 40 times a sheet thickness of the coated grain-oriented electrical steel sheet to both sides in a circumferential direction from a center of the bent region on an outer circumferential surface of the bent body is defined as a strain affected region, a proportion (local soundness rate of the coating) of an area where the coating is not damaged at any position along the circumferential direction in a flat region within the strain affected region is 90% or more.

In the wound core according to the present disclosure, the local soundness rate of the coating at an optional position along the circumferential direction in the flat region within the strain affected region is 90% or more. That is, in the bent body, local damage of the coating formed on the flat region of the outer circumferential surface of the grain-oriented electrical steel sheet is suppressed. The wound core is composed of such a bent body. Therefore, in the wound core of the present disclosure, deterioration of iron loss is suppressed as compared with a wound core composed of a bent body in which the coating in the flat region is locally damaged. The mechanism is not clear, but the wound core according to the present disclosure is based on the following findings.

(Overview of Coating Peeling Suppression)

The present inventors have earnestly studied the causes of damage to the coating formed in advance on the surface of the grain-oriented electrical steel sheet and deterioration of iron loss of the wound core. As a result, they considered that the temperature at which the coated grain-oriented electrical steel sheet is bent may affect the coating, and the soundness rate of the coating may affect the iron loss.

In a case of normal temperature bending, the soundness rate of the coating is ensured in the flat region, but the soundness rate of the coating is significantly reduced in the bent region.

Even in a case of heat bending, if the temperature gradient of the bent body in the circumferential direction is steep, strain is introduced into the flat region forming portion. As a result, during the heat bending, damage to the coating occurs in the flat region located in the vicinity of the boundary between the bent region and the flat region, and the soundness rate of the coating is greatly reduced.

On the other hand, even in the case of the heat bending, when the temperature gradient in the circumferential direction of the bent body is relaxed (gentle), the introduction of strain into the flat region forming portion is suppressed, and the integrity of the coating of the flat region forming portion is ensured.

As a result of repeated earnest studies in this way, the present inventors have found that when a steel sheet is bent and formed into a bent body under the conditions that satisfy the following (1) and (2), the soundness rate of the coating becomes 90% or more over the entire flat part of the bent body.

(1) The temperature of the steel sheet in the bent region, which is the highest temperature, is controlled to 45° C. or higher and 500° C. or lower. (2) The temperature gradient (local temperature gradient) of an optional position (all positions) of the flat region forming portion adjacent to the heated bent region forming portion in the longitudinal direction of the steel sheet (corresponding to the circumferential direction of the bent body) is less than 400° C./mm.

It is considered that, as described above, by forming a wound core by laminating a plurality of bent bodies having a high coating soundness rate over the entire flat part in the sheet thickness direction, variation of the coating in the circumferential direction is suppressed, and deterioration of iron loss due to the local damage of the coating is suppressed.

That is, the local damage of the coating is likely to occur, in each region of the strain affected region, which is equally distant from the bent region in each of the plurality of bent bodies to be laminated. Further, in each bent body, when the local damage of the coating occurs, interlayer resistance decreases at a damaged position of the coating in each bent body. From the above, when the wound core is manufactured by laminating these bent bodies after shearing (bending) the steel sheets, the damaged positions of the coatings overlap in the sheet thickness direction, and the interlayer resistance may decrease in the entire sheet thickness direction. As a result, an eddy current increases and the iron loss deteriorates. Therefore, it is considered that such deterioration of the iron loss can be suppressed by increasing the soundness rate of the coating.

Further, even when the damaged positions of the coatings do not overlap in the sheet thickness direction, when the coating is locally damaged, the coating is locally distorted and the shape of the surface layer of the steel sheet becomes locally rough, which causes welding when the steel sheets are laminated. When welding occurs, a proper coating tension is lost and the iron loss is greatly deteriorated. Therefore, it is considered that such deterioration of iron loss can be suppressed by increasing the soundness rate of the coating.

Figure 16:
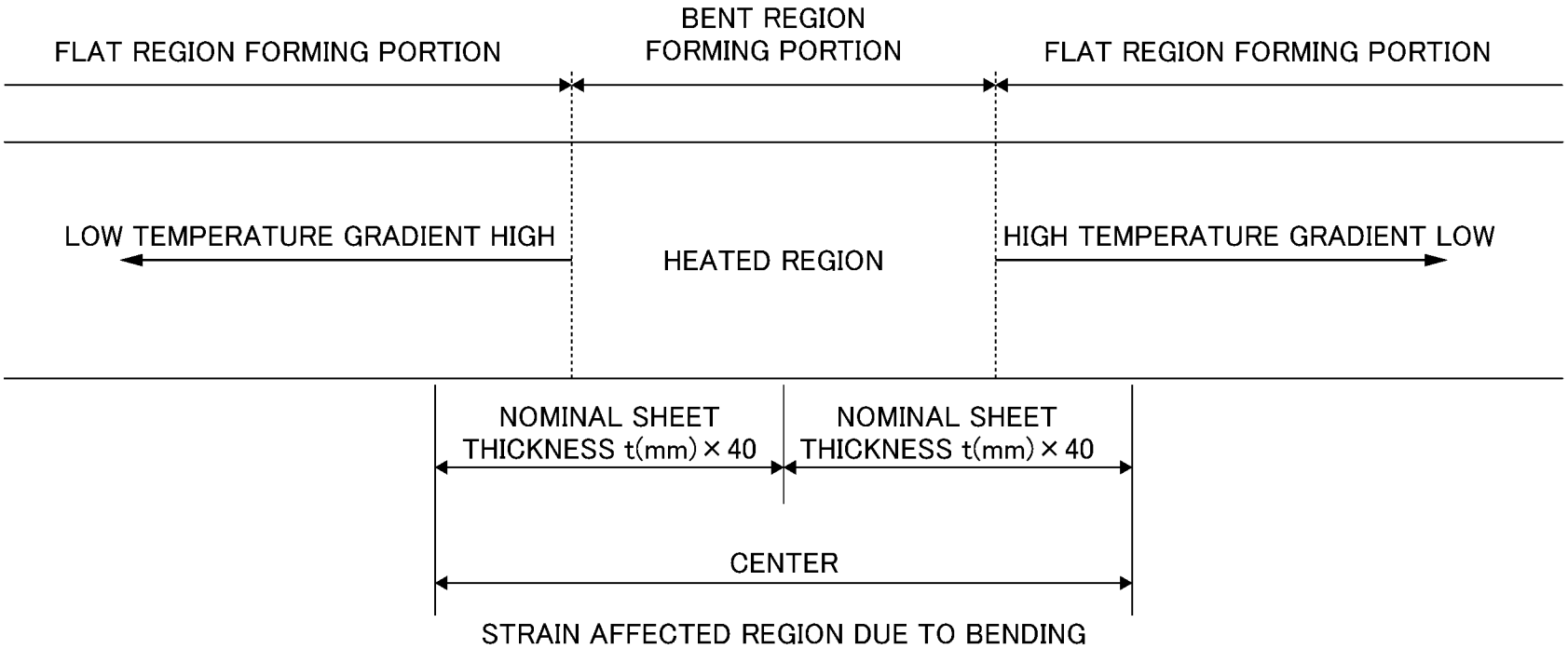
FIG. 16 is a plan view for explaining a bent region forming portion, which is a heated region, a flat region forming portion in which a temperature gradient occurs by heating the bent region forming portion, and a strain affected region due to bending.

Further, in FIG. 16, a bent region forming portion, which is a heated region at the time of bending, and a flat region forming portion in which a temperature gradient occurs by heating the bent region forming portion are schematically shown in a plan view. The present inventors have found that when the coated grain-oriented electrical steel sheet is bent to form a bent region, a region from a center position of the bent region forming portion in the longitudinal direction to 40 times the sheet thickness is a region that is greatly affected by strain due to the bending. Therefore, in the steel sheet before processing, the present inventors have defined a region up to 40 times the sheet thickness from the center position of the bent region forming portion to the front and back as a strain affected region due to bending (in the present disclosure, it may be simply referred to as a "strain affected region").

The fact that the strain affected region to be considered in the present disclosure is 40 times the sheet thickness is considered to be related to the contribution of strain (for example, "Physics of Bending Deformation" p 96-97, by Fumio Hibino, Shokabo) in consideration of elastic deformation in this region.

Note that, as is clear from FIG. 16, as a value of the sheet thickness, when a nominal sheet thickness is set for the steel sheet, a value of the nominal sheet thickness can be adopted. When the nominal sheet thickness is not set, for example, the thickness of the wound core is measured at optional ten locations, and the value obtained by dividing the average measurement result by the number of bent bodies forming the wound core can be used as a value of the sheet thickness. In a case of before manufacturing the wound core, for example, the value can also be obtained by laminating ten sheets of coated grain-oriented electrical steel sheets, measuring the thickness of the laminated steel sheets at optional ten locations, and dividing the measurement result by ten. The thickness of the wound core and the thickness of the laminated steel sheets can be measured with a micrometer. The optional ten locations may be, for example, ten locations where the total width of the steel sheet at a specific one position along the longitudinal direction (circumferential direction of the wound core) of the steel sheet is evenly spaced along the width direction.

Further, although FIG. 16 shows a case where the bent region forming portion is used as the heated region, it is naturally possible to heat the flat region forming portion as well.

Hereinafter, the coated grain-oriented electrical steel sheet and the wound core in the present disclosure will be specifically described.

(Coated Grain-Oriented Electrical Steel Sheet)

The coated grain-oriented electrical steel sheet in the present disclosure includes at least a grain-oriented electrical steel sheet (which may be referred to as a "base steel sheet" in the present disclosure) and a coating formed on at least one surface of the base steel sheet.

The coated grain-oriented electrical steel sheet has at least a primary coating as the coating, and may further have another layer as necessary. Examples of the other layer include a secondary coating provided on the primary coating.

Hereinafter, a configuration of the coated grain-oriented electrical steel sheet will be described.

<Grain-Oriented Electrical Steel Sheet>

In the coated grain-oriented electrical steel sheet which constitutes the wound core 10 according to the present disclosure, the base steel sheet is a steel sheet in which an orientation of crystal grains is highly integrated in the {110}<001> orientation. The base steel sheet has excellent magnetic characteristics in a rolling direction.

The base steel sheet used for the wound core according to the present disclosure is not particularly limited. As the base steel sheet, a known grain-oriented electrical steel sheet can be appropriately selected and used. Hereinafter, an example of a preferable base steel sheet will be described, but the base steel sheet is not limited to the following examples.

The chemical composition of the base steel sheet is not particularly limited, but preferably includes, for example, by mass %, Si: 0.8% to 7%, C: higher than 0% and 0.085% or less, acid soluble Al: 0% to 0.065%, N: 0% to 0.012%, Mn: 0% to 1%, Cr: 0% to 0.3%, Cu: 0% to 0.4%, P: 0% to 0.5%, Sn: 0% to 0.3%, Sb: 0% to 0.3%, Ni: 0% to 1%, S: 0% to 0.015%, Se: 0% to 0.015%, and a remainder consisting of Fe and impurity elements.

The chemical composition of the base steel sheet is a preferable chemical component for controlling the texture to a Goss texture in which the crystal orientation is integrated into a {110}<001> orientation.

Other than Fe, among the elements in the base steel sheet, Si and C are base elements (essential elements), and the acid soluble Al, N, Mn, Cr, Cu, P, Sn, Sb, Ni, S, and Se are selective elements (optional elements). These selective elements may be contained for their purposes. Therefore, there is no need to limit the lower limits thereof, and the selective elements may not be substantially contained. Even if these selective elements are contained as impurity elements, the effects of the present disclosure are not impaired. In the base steel sheet, the remainder of the base elements and the selective elements consists of Fe and impurity elements.

However, in a case where the Si content of the base steel sheet is 2.0% or more in terms of mass %, the classical eddy-current loss of a product is suppressed, which is preferable. The Si content of the base steel sheet is more preferably 3.0% or more.

In addition, in a case where the Si content of the base steel sheet is 5.0% or less in terms of mass %, the steel sheet is less likely to break in a hot rolling step and a cold rolling step, which is preferable. The Si content of the base steel sheet is more preferably 4.5% or less.

Note that "impurity elements" mean elements that are unintentionally mixed from ore, scrap, or the manufacturing environment as a raw material when the base steel sheet is industrially manufactured.

In addition, the grain-oriented electrical steel sheet is generally subjected to purification annealing during secondary recrystallization. In the purification annealing, inhibitor forming elements are discharged to the outside of the system. Particularly, the concentrations of N and S are significantly reduced and reach 50 ppm or less. The concentrations reach 9 ppm or less or 6 ppm or less under typical purification annealing conditions, and reach a degree (1 ppm or less) that cannot be detected by general analysis when purification annealing is sufficiently performed.

The chemical composition of the base steel sheet may be measured by a general analysis method for steel. For example, the chemical composition of the base steel sheet may be measured using inductively coupled plasma-atomic emission spectrometry (ICP-AES). Specifically, for example, the chemical composition can be specified by obtaining a 35 mm square test piece from the center position of the base steel sheet in the width direction after removing the coating and performing measurement under conditions based on a calibration curve created in advance by ICPS-8100 (measuring apparatus) manufactured by Shimadzu Corporation or the like. In addition, C and S may be measured using a combustion-infrared absorption method, and N may be measured using an inert gas fusion-thermal conductivity method.

The chemical composition of the base steel sheet is a composition obtained by analyzing the composition of the steel sheet as the base steel sheet, which is obtained by removing the glass coating that will be described later, the coating containing phosphorus, and the like from the grain-oriented electrical steel sheet by a method that will be described later.

A manufacturing method of the base steel sheet is not particularly limited, a manufacturing method of a grain-oriented electrical steel sheet, which is known in the related art, can be appropriately selected. A preferable specific example of the manufacturing method is a method of performing hot rolling by heating a slab containing 0.04 to 0.1 mass % of C and having the chemical composition of the base steel sheet to 1000° C. or higher, thereafter performing hot-rolled sheet annealing as necessary, subsequently performing cold rolling once or two or more times with process annealing therebetween to form a cold-rolled steel sheet, performing decarburization annealing by heating the cold-rolled steel sheet to 700° C. to 900° C., for example, in a wet hydrogen-inert gas atmosphere, further performing nitriding annealing thereon as necessary, and performing final annealing at about 1000° C.

The thickness of the base steel sheet is not particularly limited, but may be, for example, 0.1 mm or more and 0.5 mm or less.

Furthermore, as the grain-oriented electrical steel sheet, it is preferable to use a steel sheet in which magnetic domains are refined by application of local strain to the surface or formation of grooves in the surface. By using such a steel sheet, the iron loss can be further suppressed.

<Primary Coating>

The primary coating is a coating formed directly on the surface of a grain-oriented electrical steel sheet which is a base steel sheet without interposing another layer or film, and examples thereof include a glass coating. Examples of the glass coating include coatings having one or more oxides selected from forsterite ($Mg_2SiO_4$), spinel ($MgAl_2O_4$), and cordierite ($Mg_2Al_4Si_5O_{16}$).

A method of forming the glass coating is not particularly limited, and can be appropriately selected from known methods. For example, in a specific example of the manufacturing method of the base steel sheet, a method of applying an annealing separating agent containing one or more selected from magnesia (MgO) and alumina ($Al_2O_3$) to a cold-rolled steel sheet and performing final annealing thereon can be employed. The annealing separating agent also has an effect of suppressing sticking between steel sheets during final annealing. For example, in a case where final annealing is performed by applying the annealing separating agent containing magnesia, the annealing separating agent reacts with silica contained in the base steel sheet such that a glass coating containing forsterite ($Mg_2SiO_4$) is formed on the surface of the base steel sheet.

In addition, instead of forming the glass coating on the surface of the grain-oriented electrical steel sheet, for example, a coating containing phosphorus, which will be described later, may be formed as a primary coating.

The thickness of the primary coating is not particularly limited, but is preferably 0.5 μm or more and 3 μm or less, for example, from the viewpoint of forming on the entire surface of the base steel sheet and suppressing peeling.

<Other Coatings>

The coated grain-oriented electrical steel sheet may have a coating other than the primary coating. For example, as the secondary coating on the primary coating, it is preferable to have a coating containing phosphorus mainly for imparting insulation properties. The coating containing phosphorus is a coating formed on the outermost surface of the grain-oriented electrical steel sheet, and when the grain-oriented electrical steel sheet has a glass coating or an oxide coating as a primary coating, it is formed on the primary coating. High adhesion can be ensured by forming a coating containing phosphorus on the glass coating formed as a primary coating on the surface of the base steel sheet.

The coating containing phosphorus can be appropriately selected from among coatings known in the related art. As the coating containing phosphorus, a phosphate-based coating is preferable, and a coating containing one or more of aluminum phosphate and magnesium phosphate as a main component and one or more of chromium and silicon oxide as an auxiliary component is preferable. With the phosphate-based coating, the insulation properties of the steel sheet are secured, and tension is applied to the steel sheet, so that the steel sheet is also excellent in a reduction in iron loss.

A method of forming the coating containing phosphorus is not particularly limited, and can be appropriately selected from known methods. For example, a method of applying a coating solution, in which a coating composition is dissolved, onto the base steel sheet, and baking the resultant is preferable. Hereinafter, a preferable specific example will be described, but the method of forming the coating containing phosphorus is not limited thereto.

A coating solution containing 4 to 16 mass % of colloidal silica, 3 to 24 mass % of aluminum phosphate (calculated as aluminum biphosphate), and 0.2 to 4.5 wt % in total of one or two or more of chromic anhydride and dichromate is prepared. The coating solution is applied onto the base steel sheet or the other coatings such as the glass coating formed on the base steel sheet, and is baked at a temperature of about 350° C. or higher. Thereafter, a heat treatment is performed thereon at 800° C. to 900° C., whereby the coating containing phosphorus can be formed. The coating formed as described above has insulation properties and can apply tension to the steel sheet, thereby improving iron loss and magnetostriction characteristics.

The thickness of the coating containing phosphorus is not particularly limited, but is preferably 0.5 μm or more and 3 μm or less from the viewpoint of securing the insulation properties.

<Sheet Thickness>

The thickness of the coated grain-oriented electrical steel sheet is not particularly limited and may be appropriately selected according to the application and the like, but it is typically in a range of 0.10 mm to 0.50 mm, preferably in a range of 0.13 mm to 0.35 mm, and more preferably in a range of 0.15 mm to 0.23 mm.

(Configuration of Wound Core)

An example of the configuration of the wound core according to the present disclosure will be described by taking the wound core 10 of FIGS. 1 and 2 as an example. FIG. 1 is a perspective view of the wound core 10, and FIG. 2 is a side view of the wound core 10 of FIG. 1.

In the present disclosure, the side view means to view in the width direction (Y-axis direction in FIG. 1) of a long-shaped coated grain-oriented electrical steel sheet constituting the wound core. The side view is a view showing a shape visible from the side view (a view in the Y-axis direction of FIG. 1). In addition, a sheet thickness direction is the sheet thickness direction of the coated grain-oriented electrical steel sheet, and means a direction perpendicular to the circumferential surface of the wound core in a state of being formed in a rectangular wound core. Here, the direction perpendicular to the circumferential surface means a direction perpendicular to the circumferential surface when the circumferential surface is viewed from the side. When the circumferential surface is curved when the circumferential surface is viewed from the side, the direction perpendicular to the circumferential surface (sheet thickness direction) means a direction perpendicular to a tangent line of the curve formed by the circumferential surface.

The wound core 10 is formed by laminating a plurality of bent bodies 1 in the sheet thickness direction thereof. That is, as shown in FIGS. 1 and 2, the wound core 10 has a substantially rectangular laminated structure of the plurality of bent bodies 1. The wound core 10 may be used as it is as a wound core. If necessary, the wound core 10 may be fixed using a fastening tool such as a known binding band. The bent body 1 is formed from a coated grain-oriented electrical steel sheet having a coating formed on at least one surface of the grain-oriented electrical steel sheet which is a base steel sheet.

Figure 2:
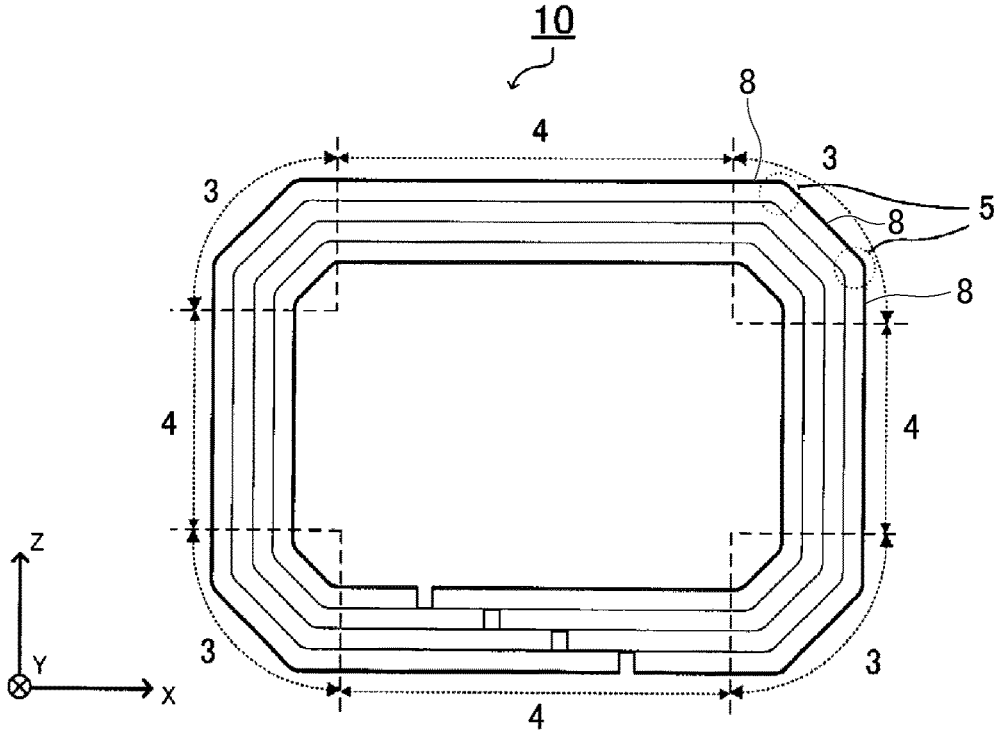
FIG. 2 is a side view of a wound core of FIG. 1.

As shown in FIGS. 1 and 2, each of the bent bodies 1 is formed in a rectangular shape by alternately connecting four flat parts 4 and four corner portions 3 along a circumferential direction. The angle between the two flat parts 4 adjacent to corner portion 3 is approximately 90°. Here, the circumferential direction means a direction in which the wound core 10 orbits around the axis.

As shown in FIG. 2, in the wound core 10, each of the corner portions 3 of the bent body 1 has two bent regions 5. The bent region 5 is a region having a shape bent in a curved shape in a side view of the bent body 1, and a more specific definition thereof will be described later. As will be described later, in the two bent regions 5, the total bending angle is approximately 90° in the side view of the bent body 1.

Figure 3:
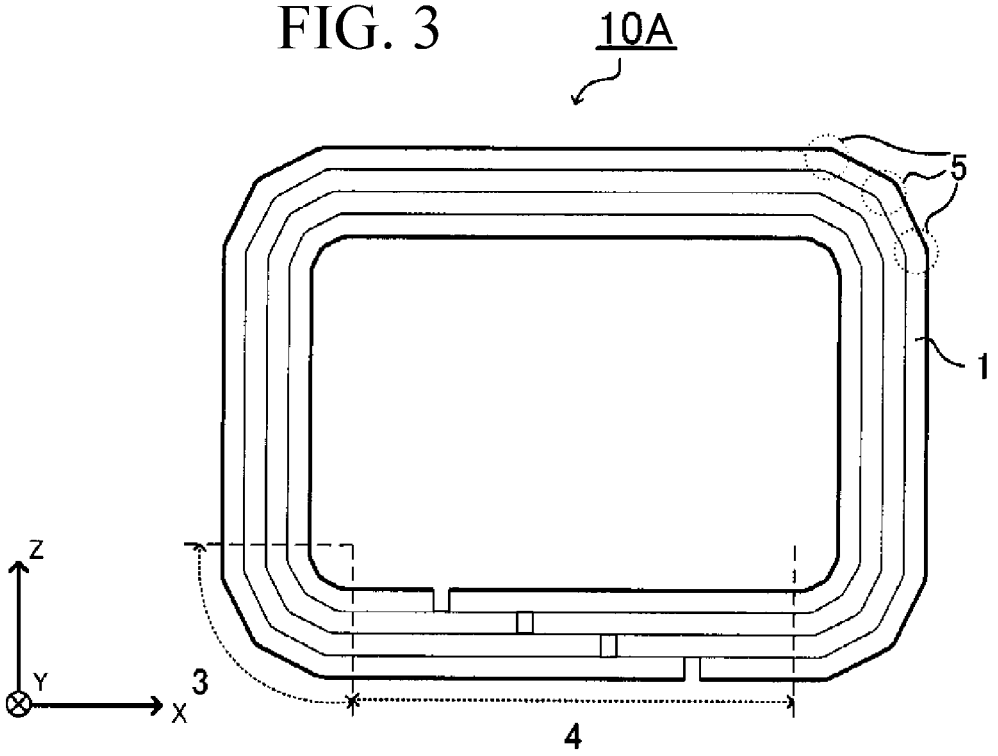
FIG. 3 is a side view showing a first modification example of a wound core of FIG. 1.
Figure 4:
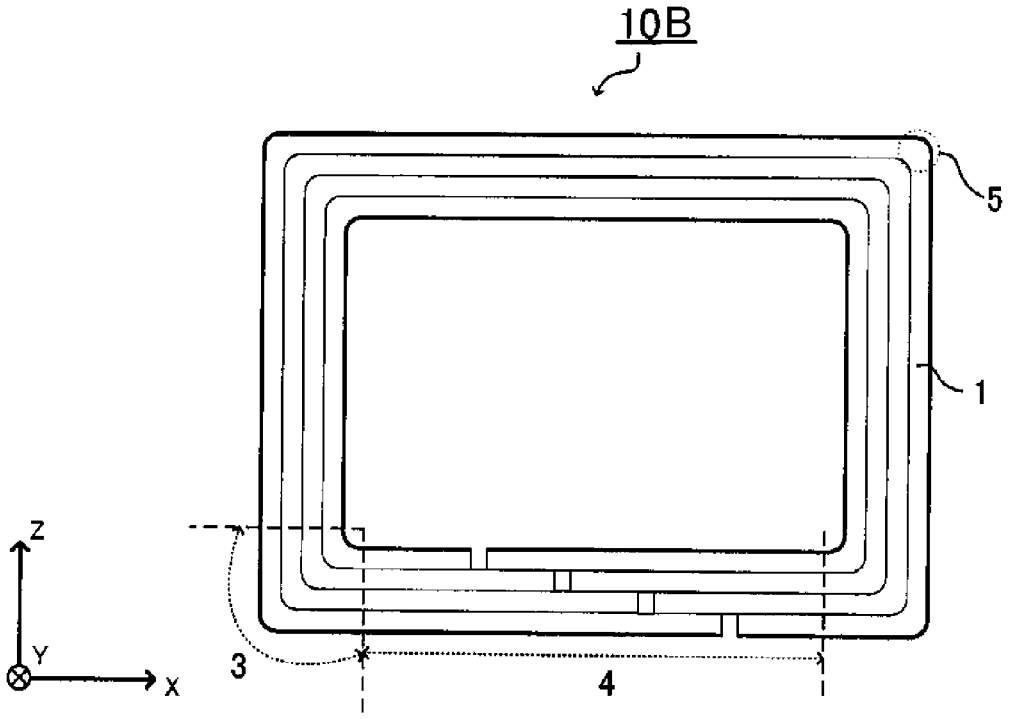
FIG. 4 is a side view showing a second modification example of a wound core of FIG. 1.

Each of the corner portions 3 of the bent body 1 may have three bent regions 5 in one corner portion 3 as in a wound core 10A according to a first modification example shown in FIG. 3. Further, as in a wound core 10B according to a second modification example shown in FIG. 4, one corner portion 3 may have one bent region 5. That is, each of the corner portions 3 of the bent body 1 may have one or more bent regions 5 so that the steel sheet can be bent by approximately 90°.

As shown in FIG. 2, the bent body 1 has a flat region 8 adjacent to the bent region 5. As the flat region 8 adjacent to the bent region 5, there are two flat regions 8 shown in the following (1) and (2).

(1) A flat region 8 that is located between a bent region 5 and a bent region 5 (between two bent regions 5 adjacent to each other in the circumferential direction) in one corner portion 3 and adjacent to each of the bent regions 5.

(2) A flat region 8 that is adjacent to each of the bent regions 5 as a flat part 4.

Figure 5:
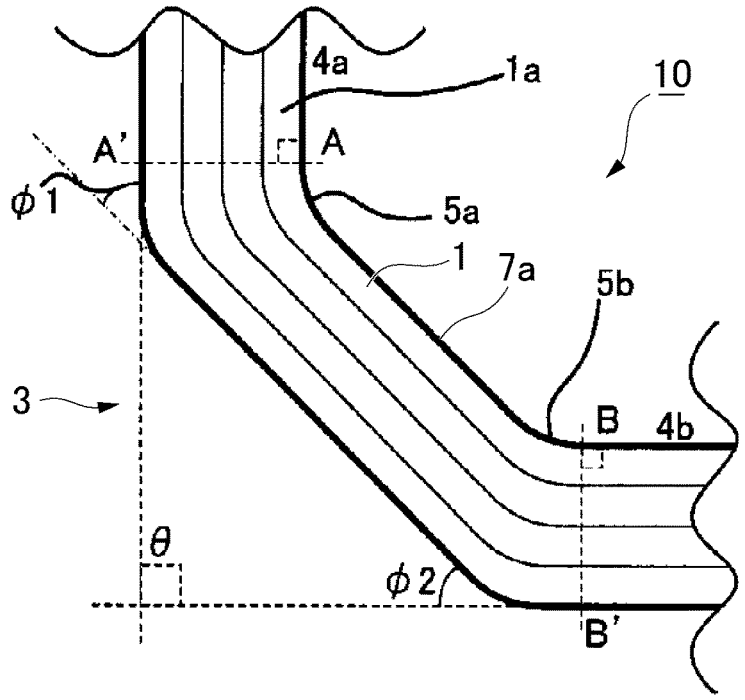
FIG. 5 is an enlarged side view of a vicinity of a corner portion in a wound core of FIG. 1.

FIG. 5 is an enlarged side view of the vicinity of the corner portion 3 in the wound core 10 of FIG. 1.

As shown in FIG. 5, when one corner portion 3 has two bent regions 5*a* and 5*b*, the flat part 4*a* (straight portion), which is a flat region of the bent body 1, is continuous with the bent region 5*a* (curved portion), and further, the flat region 7*a* (straight portion), the bent region 5*b* (curved portion), and the flat part 4*b* (straight portion), which is a flat region, are continuous.

In the wound core 10, a region from a segment A-A' to a segment B-B' in FIG. 5 is the corner portion 3. A point A is an end point on the flat part 4*a* side of the bent region 5*a* of the bent body 1*a* disposed on the innermost side of the wound core 10. A point A' is an intersection point of a straight line passing through the point A and perpendicular direction (sheet thickness direction) to the sheet surface of the bent body 1*a* and an outermost surface (outer circumferential surface of the bent body 1 disposed on the outermost side of the wound core 10) of the wound core 10. Similarly, a point B is an end point on the flat part 4*b* side in the bent region 5*b* of the bent body 1*a* disposed on the innermost side of the wound core 10. A point B' is an intersection point of a straight line passing through the point B and perpendicular direction (sheet thickness direction) to the sheet surface of the bent body 1*a* and an outermost surface of the wound core 10. In FIG. 5, the angle formed by the two flat parts 4*a* and 4*b* adjacent to each other via the corner portion 3 (the angle formed by an intersection point of extension lines of the flat parts 4*a* and 4*b*) is θ, and in the example of FIG. 5, the θ is approximately 90°. The bending angle of the bent regions 5*a* and 5*b* will be described later, but in FIG. 5, the total φ1+φ2 of bending angles of the bent regions 5*a* and 5*b* is approximately 90°.

Figure 6:
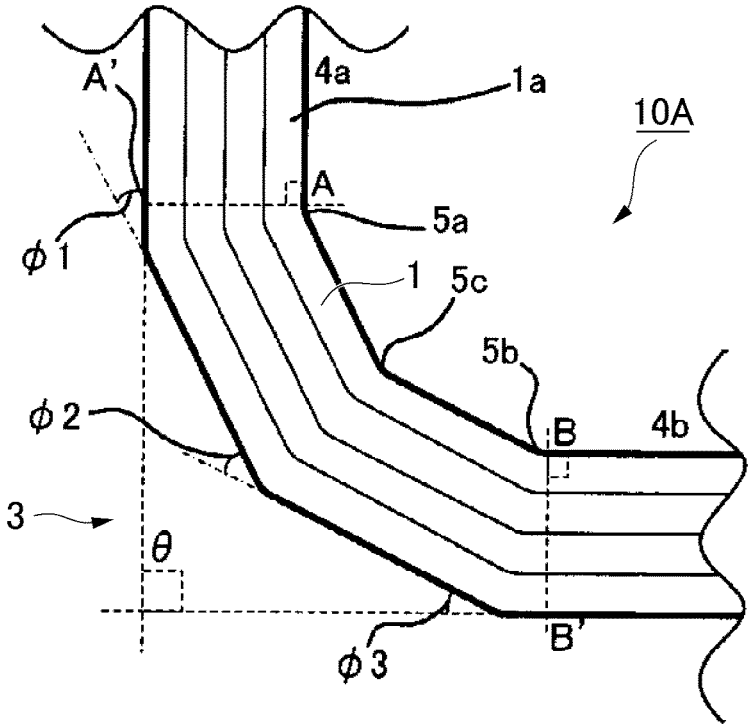
FIG. 6 is an enlarged side view of a vicinity of a corner portion in a wound core according to a first modification example of FIG. 3.

Next, a case where one corner portion 3 has three bent regions 5 will be described. FIG. 6 is an enlarged side view of the vicinity of the corner portion 3 in the wound core 10A according to the first modification example shown in FIG. 3. In FIG. 6, as in FIG. 5, the region from the segment A-A' to the segment B-B' is the corner portion 3. In FIG. 6, a point A is an end point on the flat part 4*a* side of the bent region 5*a* closest to the flat part 4*a*. A point B is an end point on the flat part 4*b* side of the bent region 5*b* closest to the flat part 4*b*. In a case where there are three bent regions 5, a flat region is present between the bent regions. In the example of FIG. 6, a total bending angle φ1+φ2+φ3 of the bent regions 5*a*, 5*b*, and 5*c* is approximately 90°. Generally, when the corner portion 3 has n bent regions 5, the total bending angle φ1+φ2+ . . . +φn of the bent regions 5 is approximately 90°.

Figure 7:
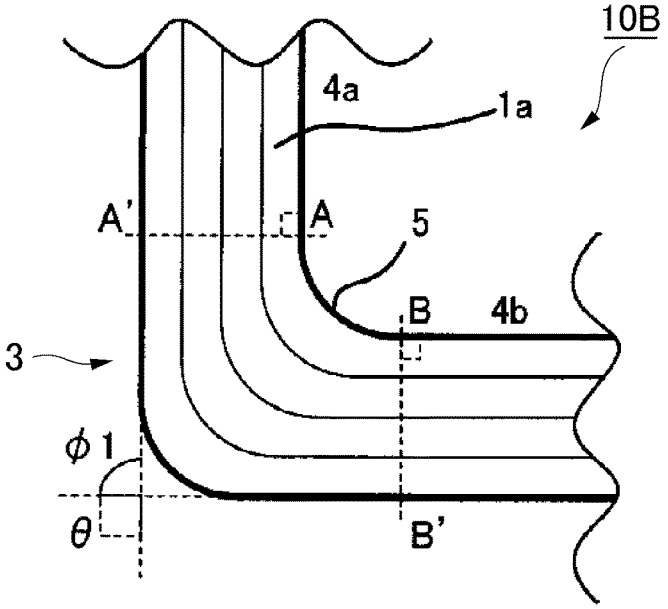
FIG. 7 is an enlarged side view of a vicinity of a corner portion in a wound core according to a second modification example of FIG. 4.

Next, a case where one corner portion 3 has one bent region 5 will be described. FIG. 7 is an enlarged side view of the vicinity of the corner portion 3 in a wound core 10B according to a second modification example shown in FIG. 4. In FIG. 7, as in FIGS. 5 and 6, the region from the segment A-A' to the segment B-B' is the corner portion 3. In FIG. 7, a point A is an end point of the bent region 5 on the flat part 4*a* side. A point B is an end point of the bent region 5 on the flat part 4*b* side. Further, in the example of FIG. 7, the bending angle φ1 of the bent region 5 is approximately 90°.

In the present disclosure, since the angle θ of the corner portion described above is approximately 90°, the bending angle φ of one bent region is approximately 90° or less. From the viewpoint of suppressing peeling of the coating of the steel sheet and suppressing iron loss, the bending angle φ of one bent region is preferably 60° or less, and more preferably 45° or less. Therefore, it is preferable that one corner portion 3 has two or more bent regions 5. However, it is difficult to form four or more bent regions 5 in one corner portion 3 due to restrictions on the design of manufacturing facilities. Therefore, the number of bent regions 5 in one corner portion is preferably three or less.

As in the wound core 10 shown in FIG. 5, in a case where one corner portion 3 has two bent regions 5*a* and 5*b*, it is preferable that φ1=45° and φ2=45° are satisfied from the viewpoint of suppressing peeling of the coating and reducing iron loss. However, for example, φ1=60° and φ2=30°, φ1=30° and φ2=60°, or the like may be satisfied.

As in the wound core 10A according to the first modification example shown in FIG. 6, in a case where one corner portion 3 has three bent regions 5*a*, 5*b*, and 5*c*, it is preferable that φ1=30°, φ2=30°, and φ3=30° are satisfied from the viewpoint of reducing iron loss.

Furthermore, since it is preferable that the bending angles in the bent region are equal to each other from the viewpoint of production efficiency, in a case where one corner portion 3 has two bent regions 5*a* and 5*b* (FIG. 5), φ1=45° and φ2=45° are preferably satisfied, and in a case where one corner portion 3 has three bent regions 5*a*, 5*b*, and 5*c* (FIG. 6), for example, φ1=30°, φ2=30°, and φ3=30° are preferably satisfied from the viewpoint of suppressing peeling of the coating and reducing iron loss.

Figure 8:
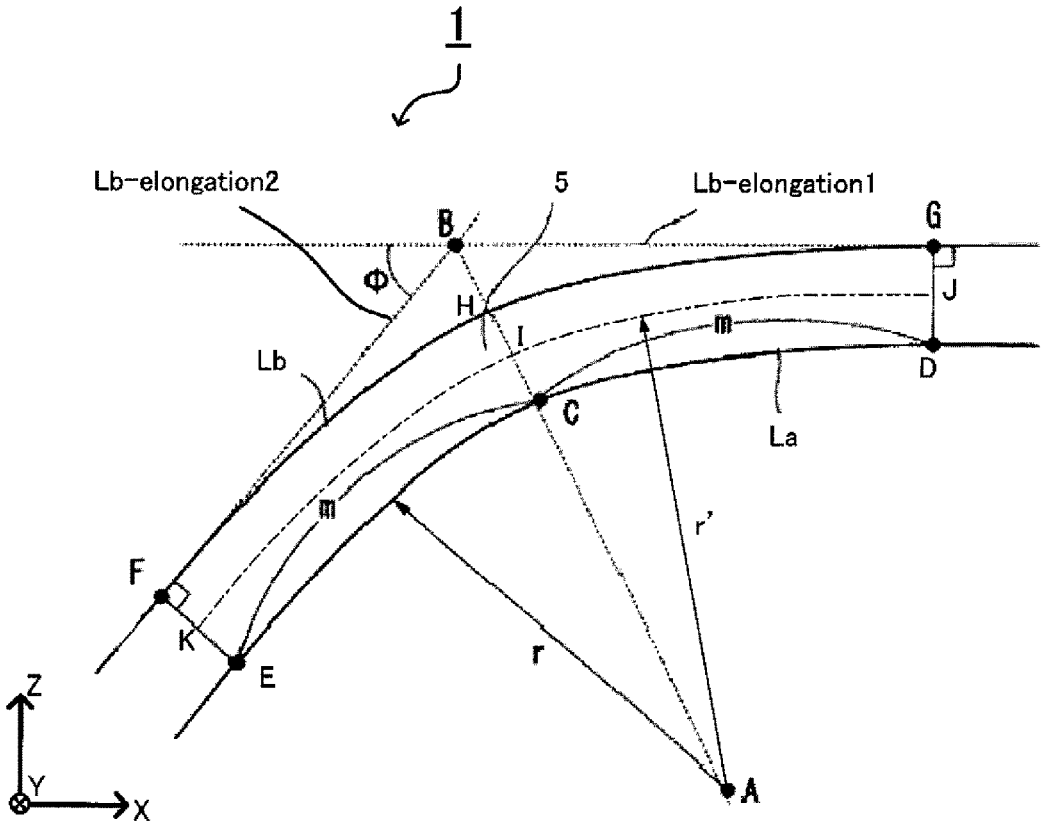
FIG. 8 is an enlarged side view of an example of a bent region.

The bent region 5 will be described in more detail with reference to FIG. 8. FIG. 8 is an enlarged side view showing an example of the bent region 5 of the bent body 1. A bending angle φ of the bent region 5 means an angular difference generated between a flat region on a rear side in the bending direction and a flat region on a front side in the bending direction in the bent region 5 of the bent body 1. Specifically, the bending angle φ of the bent region 5 is represented by a complementary angle φ of the angle between two imaginary lines Lb-elongation1 and Lb-elongation2 obtained by extending straight portions each continuous to both sides (a point F and a point G) of a curved portion included in a line Lb representing the outer surface of the bent body 1, in the bent region 5.

The bending angle of each bent region 5 is approximately 90° or less, and the sum of the bending angles of all the bent regions 5 present in one corner portion 3 is substantially 90°.

The bent region 5 represents a region enclosed by, in a side view of the bent body 1, when a point D and a point E on a line La representing the inner surface of the bent body 1 and the point F and the point G on the line Lb representing the outer surface of the bent body 1 are defined as follows, (1) a line delimited by the point D and the point E on the line La representing the inner surface of the bent body 1, (2) a line delimited by the point F and the point G on the line Lb representing the outer surface of the bent body 1, (3) a straight line connecting the point D and the point G, and (4) a straight line connecting the point E and the point F.

Here, the points D, E, F, and G are defined as follows.

In a side view, a point at which a straight line AB connecting the center point A of the radius of curvature of a curved portion included in the line La representing the inner surface of the bent body 1 to the point of intersection point B between the two imaginary lines Lb-elongation1 and Lb-elongation2 obtained by extending the straight portions adjacent to both sides of a curved portion included in the line Lb representing the outer surface of the bent body 1 intersects the line La representing the inner surface of the bent body 1 is referred to as the origin C, a point separated from the origin C by a distance m represented by following Equation (2) in one direction along the line La representing the inner surface of the bent body 1 is referred to as the point D, a point separated from the origin C by the distance m in the other direction along the line La representing the inner surface of the bent body is referred to as the point E, the intersection point between a straight portion opposing the point D in the straight portion included in the line Lb representing the outer surface of the bent body and an imaginary line drawn perpendicularly to the straight portion opposing the point D through the point D is referred to as the point G, and the intersection point between a straight portion opposing the point E in the straight portion included in the line Lb representing the outer surface of the bent body and an imaginary line drawn perpendicularly to the straight portion opposing the point E through the point E is referred to as the point F.

$$m=r\times(\pi\times\varphi/180) \quad (2)$$

In Equation (2), in represents a distance from the origin C, and r represents a distance (radius of curvature) from the center point A to the origin C.

That is, r represents the radius of curvature in a case where a curve in the vicinity of the origin C is regarded as an arc, and represents an inner surface side radius of curvature in a side view of the bent region 5. As the radius of curvature r decreases, the curve of the curved portion of the bent region 5 becomes sharp, and as the radius of curvature r increases, the curve of the curved portion of the bent region 5 becomes smooth.

Even in a case where the bent region 5 having a radius of curvature r of 3 mm or less is formed by bending, since the peeling of the coating in the bent region 5 is suppressed, a wound core with low iron loss can be obtained.

Figure 9:
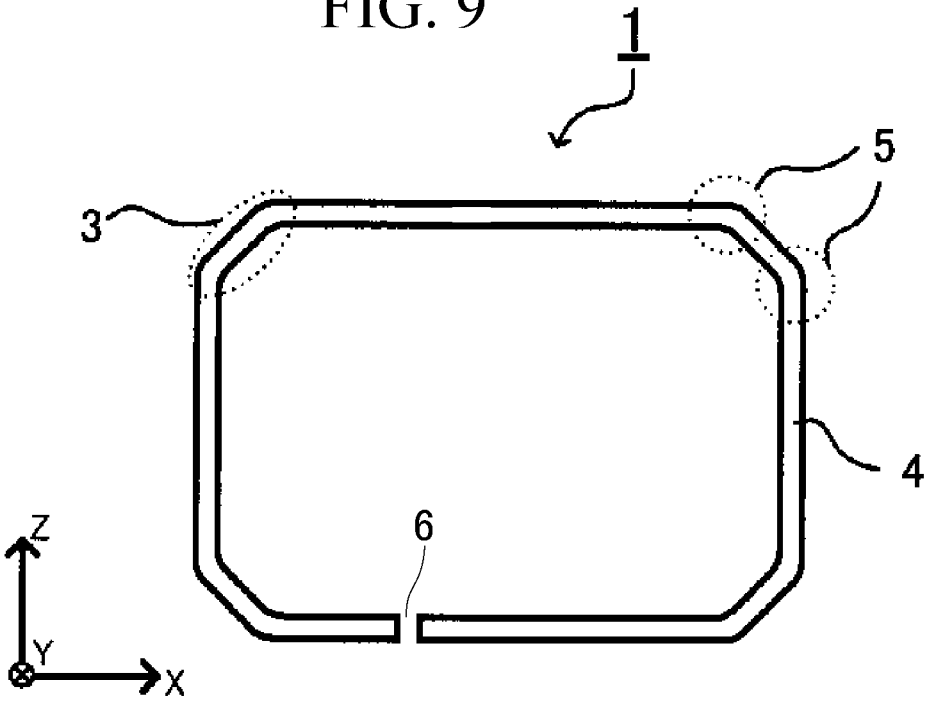
FIG. 9 is a side view of a bent body of a wound core of FIG. 1.

FIG. 9 is a side view of the bent body 1 of the wound core 10 of FIG. 1. As shown in FIG. 9, the bent body 1 is formed by bending a coated grain-oriented electrical steel sheet and has four corner portions 3 and four flat parts 4, whereby one coated grain-oriented electrical steel sheet forms a substantially rectangular ring in a side view. More specifically, in the bent body 1, one flat part 4 is provided with a gap 6 in which both end surfaces of the coated grain-oriented electrical steel sheet in the longitudinal direction face each other, and the other three flat parts 4 do not include a gap 6.

Figure 10:
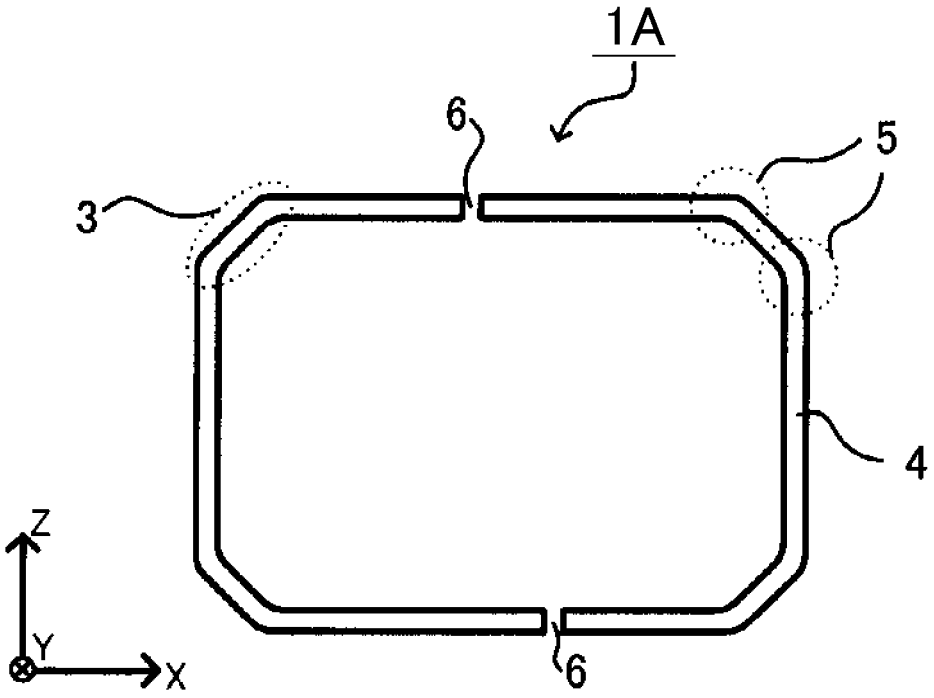
FIG. 10 is a side view showing a modification example of a bent body of FIG. 9.

However, the wound core 10 may have a substantially rectangular laminated structure as a whole in a side view. Therefore, as a modification example, as shown in FIG. 10, a bent body 1A in which two flat parts 4 have gaps 6 and the other two flat parts 4 have no gap 6 may be used. In this case, two coated grain-oriented electrical steel sheets constitute the bent body.

Figure 11:
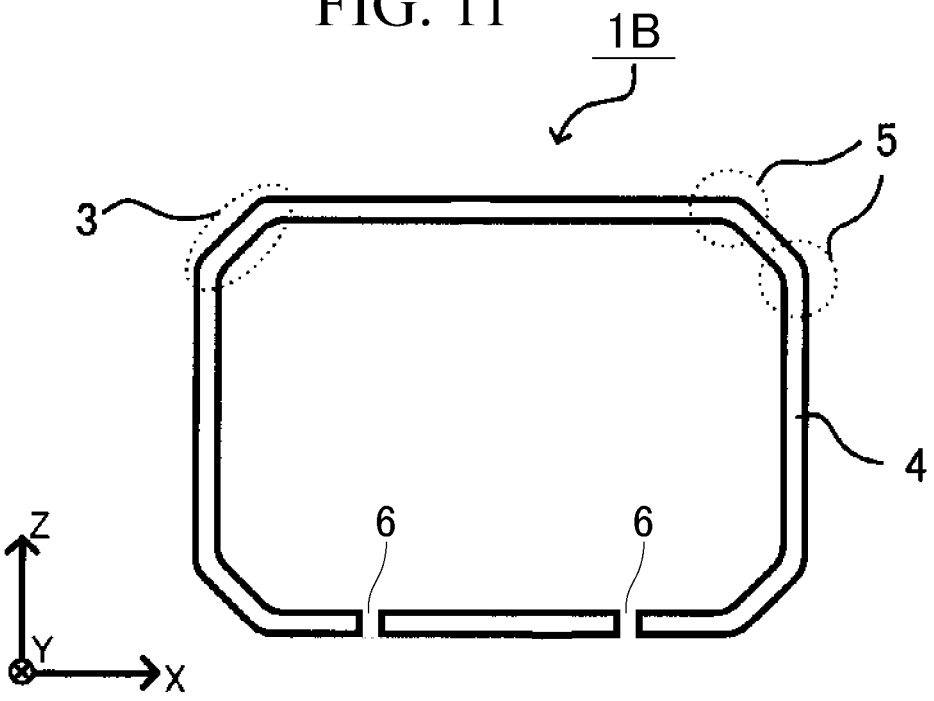
FIG. 11 is a side view showing another modification example of a bent body of FIG. 9.

Further, as another modification example in a case where two coated grain-oriented electrical steel sheets constitute a bent body, as shown in FIG. 11, a bent body 1B in which one flat part 4 has two gaps 6 and the other three flat parts 4 have no gap 6 may be used. That is, the bent body 1B is configured by combining a coated grain-oriented electrical steel sheet that has been bent so as to correspond to three sides of substantially rectangular shape and a coated grain-oriented electrical steel sheet that is flat (straight in a side view) so as to correspond to the remaining one side. In a case where two or more coated grain-oriented electrical steel sheets constitute a bent body as described above, a bent body of a steel sheet and a flat (straight in a side view) steel sheet may be combined.

In either case, it is desirable that no gap is formed between two layers adjacent to each other in the sheet thickness direction when manufacturing a wound core. Therefore, in the two layers of adjacent bent bodies, the length of the steel sheet and the position of the bent region are adjusted so that an outer circumferential length of the flat part 4 of the bent body disposed inside and an inner circumferential length of the flat part 4 of the bent body disposed outside are equal.

<Number of Deformation Twins of Bent Part>

In the wound core 10 according to the present disclosure, in a side view, the number of deformation twins present in the bent region 5 is five or less per 1 mm of the length of the center line in the sheet thickness direction in the bent region 5.

That is, in a case where the length of the center line in the sheet thickness direction in "all the bent regions 5 included in one corner portion 3 of one bent body 1 of the wound core 10" is referred to as $L_{Total}$ (mm) and the number of deformation twins included in "all the bent regions 5 included in one corner portion 3 of one bent body 1 of the wound core 10" is referred to as $N_{total}$ (count), the value of $N_{total}/L_{total}$ (count/mm) is five or less.

Figure 17:
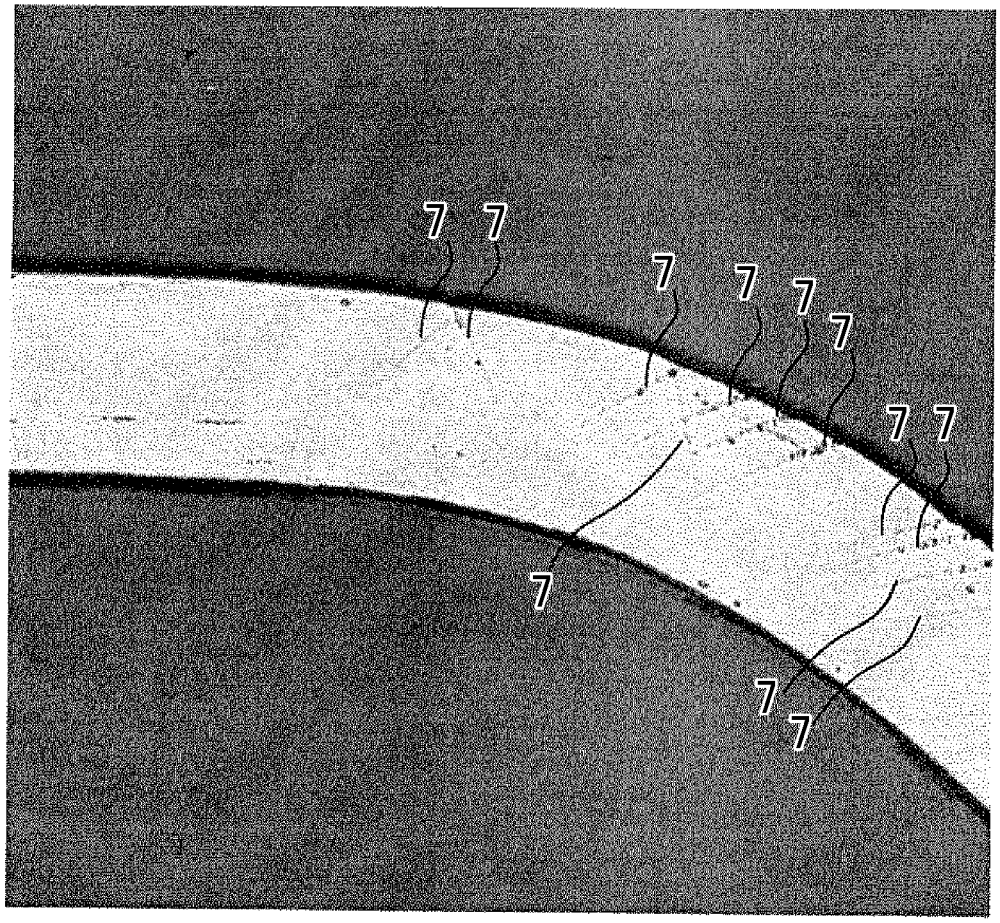
FIG. 17 is an optical micrograph showing streaky deformation twins generated in the bent region of a bent body in the related art.

The number of deformation twins present in the bent region 5 is preferably four or less per 1 mm of the length of the center line in the sheet thickness direction in the bent region 5 and is more preferably three or less. FIG. 17 shows deformation twins generated at the bent region of the bent body formed from the grain-oriented electrical steel sheet constituting the wound core in the related art, streaky deformation twins 7 are observed from the surface of the steel sheet toward the inside of the surface of the steel sheet.

The number of deformation twins present in the bent region 5 in a side view may be determined by photographing a cross section of the bent region 5 along the circumferential direction (equivalent to the longitudinal direction of the coated grain-oriented electrical steel sheet) and the sheet thickness direction of the bent body using an optical microscope and counting the number of streaky deformation twins 7 from the surface of the steel sheet to the inside of the surface of the steel sheet. Deformation twins are formed on the outer circumferential surface of the wound core and the inner circumferential surface of the wound core of the steel sheet. In the present disclosure, deformation twins formed on the outer circumferential surface and deformation twins formed on the inner circumferential surface are added. Further, the presence of deformation twins can be confirmed by analysis and evaluation using a scanning electron microscope and crystal orientation analysis software (EBSD: Electron BackScatter Diffraction). Note that regarding deformation twins, when the magnification in the cross section observation is 100 times, deformation twins satisfying the following two requirements are defined as one deformation twin.

(1) It is a line extending from the sheet thickness surface side (outside) of the cross section toward a thickness middle portion and having a color different from that of the base steel sheet.

(2) A length of the line is 10 μm or more, and a width of the line is 3 μm or more. Incidentally, the length of the line is preferably 180 μm or less.

Here, a method of preparing a sample for observing the cross section of the bent region 5 will be described using the wound core 10 according to the present disclosure as an example.

As for the sample for observing the cross section of the bent region 5, for example, the cross section of the bent region 5 is mirror-finished by SiC polishing paper and diamond polishing in the same manner as in general cross section structure observation. Last, in order to corrode the structure, the sample is immersed in a solution obtained by adding two to three drops of picric acid and hydrochloric acid to 3% Nital for about 20 seconds to corrode the structure. As a result, a sample for observing the cross section of the bent region 5 is prepared.

In addition, the length of the center line in the sheet thickness direction of the grain-oriented electrical steel sheet (bent body 1) is the length of a curve KJ in FIG. 8, and is specifically determined as follows. A point where the straight line AB defined as described above and the line representing the outer circumferential surface of the grain-oriented electrical steel sheet (bent body 1) intersect is referred to as a point H, and the midpoint between the point H and the origin C is referred to as a point I. At this time, the distance (radius of curvature) between the midpoint A to the point I is referred to as r', and m' is calculated by the following Equation (2'). At this time, the length of the center line in the sheet thickness direction of the grain-oriented electrical steel sheet (bent body 1) becomes twice m' (2m'). In addition, a point K is a midpoint of a segment EF, and a point J is a midpoint of a segment GD.

$$m' = r' \times (\pi \times \varphi / 180) \quad \text{Equation (2'):}$$

In Equation (2'), m' represents the length from the point I to the point K and the point J, and r' represents the distance from the center point A to the point I (radius of curvature).

In the present disclosure, the number of deformation twins can be determined for at least ten bent regions per wound core, and the average thereof can be adopted as the number of deformation twins as an evaluation.

<Soundness Rate of Coating>

In the present disclosure, the soundness rate of the coating is defined in the circumferential direction (corresponding to the longitudinal direction of the coated grain-oriented electrical steel sheet) on the outer circumferential surface of the bent body constituting the wound core.

In the present disclosure, the flat region within the strain affected region on the outer circumferential surface of the bent body is divided into fine minute regions, and the "soundness rate" in the minute region is defined. The "soundness rate" within the minute region can be used to evaluate changes in the soundness rate and local peak value within a continuous wide strain affected region. In the present disclosure, the "soundness rate" in the minute region is referred to as a "local soundness rate". Note that the "(local) soundness rate of the coating" in the present disclosure means the soundness rate of the primary coating when only the primary coating is formed on the grain-oriented electrical steel sheet, and means the soundness rate of the coating including the primary coating and the other coating on the primary coating when another coating is formed on the primary coating. The "local soundness rate" will be described below.

In the present disclosure, in the flat region within the strain affected region on the outer circumferential surface of the bent body, a minute region is divided into a region having a width of 0.5 mm (length in the circumferential direction) in the circumferential direction of the outer circumferential surface of the bent body. At this time, the region having a width of 0.5 mm is divided from the side closer to the bent region. The region is divided in order from the side closer to the bent region and when the flat region within the strain affected region has a width of less than 0.5 mm on the side farther from the bent region, the width is set to 0.5 mm and one minute region is set outside the flat region in the strain affected region. For example, when the length of the flat region in the circumferential direction within the strain affected region is 6.3 mm, 12 minute regions having a width of 0.5 mm are divided inside the flat region within the strain affected region, and further, one minute region extended by 0.2 mm is set in the region outside the flat region within the strain affected region. In this case, a total of 13 minute regions are set.

Then, it is preferable that the local soundness rate of an optional position (minute region) in the flat region within the strain affected region on the outer circumferential surface of the bent body is 90% or more. As can be seen from the above division, the local soundness rate is a value determined at 0.5 mm intervals in the flat region, but the value at an optional position (local soundness rate in all minute regions) is 90% or more. Needless to say, the value is preferably 95% or more, more preferably 98% or more, and 100% is the best state.

<Measurement of Soundness Rate>

In order to determine the soundness rate described above, on the surface (outer circumferential surface of the bent body) of the coated grain-oriented electrical steel sheet, it is necessary to recognize a region where coating covers the base steel sheet and a region where the coating is damaged. This method will be described.

In the present disclosure, a status of coating damage is discriminated by surface observation with a digital camera and the color tone (shade) of the observed image. A region with damaged coating is identified by using the fact that the region is observed in a lighter color tone than regions where the coating is not damaged. More specifically, in the present disclosure, (1) brightness of the image in the region where the damage has not occurred and (2) brightness of the image in the region where the damage has occurred are acquired in advance. Then, (3) an image of the region to be evaluated is acquired, and (4) based on the two types of brightness acquired in advance, the presence or absence of damage in the image of the region to be evaluated is determined, and the soundness rate (area rate without damage) of each minute region is calculated.

Specifically, (1) first, the brightness of the image in the region where the coating damage has not occurred is acquired. At this time, five or more flat regions A (flat regions A sufficiently distant from the bent region) where coating damage has not occurred are observed, and average brightness BA of the image is obtained. At this time, there is no problem as long as the flat region A is a region separated from the bent region in the circumferential direction by more than 40 times the sheet thickness of the steel sheet. Further, when observing five or more locations, in a case where the number of bent bodies (steel sheet) forming the wound core is five or more, it is desirable to observe each region in which the positions in the circumferential direction are the same in five or more bent bodies that are different from each other. As such five or more bent bodies, it is desirable to select five or more bent bodies including a bent body located on the outermost side in the sheet thickness direction (lamination direction) and a bent body located on the innermost side, and arranged at equal intervals in the sheet thickness direction. In this case, in each bent body, the position in a sheet width direction for which an image is to be acquired is preferably the center in the sheet width direction. Further, the size of the image is preferably a square with a side of 0.5 mm.

In addition, (2) the brightness of the image in the region where the coating damage has occurred is acquired. At this time, for example, the brightness of the image is acquired after preparing a sample of the damaged region. The sample of the damaged region is prepared as follows. First, a damage sample is cut out from a flat region (a flat region sufficiently distant from the bent region) in which the coating of the bent body is not damaged. An example of the damage sample is a square having a side of 20 mm. The sample is bent with a radius of 3 mm by a method described in JIS K-5600, for example, using a type II bending resistance tester (cylindrical mandrel method) manufactured by TP Giken Co., Ltd. Further, the bent portion is unbent with the inside and the outside reversed. The above bending and unbending operations are performed three times to obtain a sample in which the coating is sufficiently damaged. In the sample, a region B that has been bent and unbent is observed at five or more locations, and average brightness BB of the image is obtained. When observing five or more locations, in a case where the number of bent bodies (steel sheet) forming the wound core is five or more, it is desirable to cut out a sample from each of the regions where the positions in the circumferential direction are the same in five or more bent bodies different from each other and observe the sample. It is preferable that the method for selecting five or more bent bodies, the position in the sheet width direction for which the sample is to be acquired, and the size of the image are the same as those shown in (1) above.

Further, (3) five or more flat regions within the strain affected region on the outer circumferential surface of the bent body to be evaluated in the present disclosure are observed. That is, similarly to the above (1) and (2), first, five or more bent bodies are selected. In each selected bent body, all minute regions set within the strain affected region are observed. As a result, all minute regions (that is, flat regions) within the strain affected region are observed at five or more locations. Note that the position in the sheet width direction for which the image is to be acquired in each minute region is preferably a center in the sheet width direction. Further, the size of the image is preferably a square with a side of 0.5 mm.

The observations of (1) to (3) do not depend on the observation equipment. For example, as a general commercially available digital camera, Canon PowerShot SX710 HS (BK) can be mentioned. An image observation resolution is set so that a spatial resolution per pixel of a magnetic domain image is 20 μm or less. Note that from the viewpoint of work man-hours, it is preferable to observe only 5 points (5 sheets) in any of the above measurements (1) to (3). Further, when the number of bent bodies (steel sheet) forming the wound core is less than 5, a plurality of points may be observed in one bent body.

Next, (4) each image obtained by photographing the strain affected region is image-processed using a density displacement measurement software "Gray-val" (manufactured by Library Co., Ltd.). The image is binarized with the average brightness of brightness BA and brightness BB (that is, (BA+BB)/2) as a boundary, and an area rate is calculated by assuming that a region darker than the boundary value (low brightness) is a sound region where the coating is not damaged. In the present disclosure, the above-described "local soundness rate" is obtained for each of the five or more strain affected regions, and the measurements at the five or more points are averaged to obtain the "local soundness rate" in the flat region within the strain affected region. That is, first, the "local soundness rates" are obtained at 5 or more locations for all the minute regions within the strain affected region. In other words, in this stage, the local soundness rate (basic local soundness rate) of (total number of minute regions)×(5 or more locations) is obtained. Then, the average local soundness rate (average local soundness rate) for each of the all of the minute regions within the strain affected region is obtained. That is, in five or more bent bodies, the average value of the "basic local soundness rates" calculated for the corresponding minute regions is calculated. In other words, in this stage, the same number of local soundness rates as the total number of minute regions are obtained.

In the wound core according to the present disclosure, the "average local soundness rate" for all the minute regions within the strain affected region is 90% or more as described above.

[Manufacturing Method of Wound Core]

Next, a manufacturing method of the wound core according to the present disclosure will be described.

The manufacturing method of the wound core according to the present disclosure described above is not particularly limited, but the manufacturing method of the wound core according to the present disclosure described below is preferably used.

In other words, the manufacturing method of the wound core according to the present disclosure includes, a steel sheet preparation step of preparing a coated grain-oriented electrical steel sheet having a coating formed on at least one surface of a grain-oriented electrical steel sheet, a bending step of bending the coated grain-oriented electrical steel sheet to form a bent body having a bent region bent so that the coating is on an outside and a flat region adjacent to the bent region, under a condition that, a portion of the bent body to be the bent region is heated to 45° C. or higher and 500° C. or lower, when a region extending 40 times the sheet thickness of the coated grain-oriented electrical steel sheet, which is adjacent to the heated portion to be the bent region, to both sides in the circumferential direction from a center of the bent region is defined as a strain affected region, a temperature gradient at any position of a portion to be the flat region within the strain affected region in the longitudinal direction of the coated grain-oriented electrical steel sheet is less than 400° C./mm; and a lamination step of laminating the plurality of the bent bodies in the sheet thickness direction.

(Steel Sheet Preparation Step)

First, a coated grain-oriented electrical steel sheet having a coating formed on at least one surface of a grain-oriented electrical steel sheet is prepared. The coated grain-oriented electrical steel sheet may be manufactured, or commercially available products may be obtained. Since the structure of the base steel sheet of the coated grain-oriented electrical steel sheet, the structure of the coating, the manufacturing method, and the like are as described above, the description thereof is omitted here.

(Bending Step)

Next, if necessary, the coated grain-oriented electrical steel sheet is cut to a desired length, and then formed into an annular bent body so that a coating is on the outside. At this time, the coated grain-oriented electrical steel sheet is bent and formed into a bent body under the conditions that satisfy the following (1) and (2).

(1) The portion of the bent body to be the bent region (bent region forming portion) is heated to 45° C. or higher and 500° C. or lower.

(2) In the flat region adjacent to the heated bent region forming portion as in (1) above and located within the strain affected region, the temperature gradient at an optional position in the longitudinal direction of the coated grain-oriented electrical steel sheet is less than 400° C./mm.

The coated grain-oriented electrical steel sheet is formed into a bent body 1 so as to satisfy the above conditions. As described above, the bent body has a bent region that is bent and a flat region adjacent to the bent region. In the bent body 1, flat parts and corner portions are alternately continuous. In each corner portion, an angle between the two flat parts adjacent to each other is approximately 90°.

Figure 12:
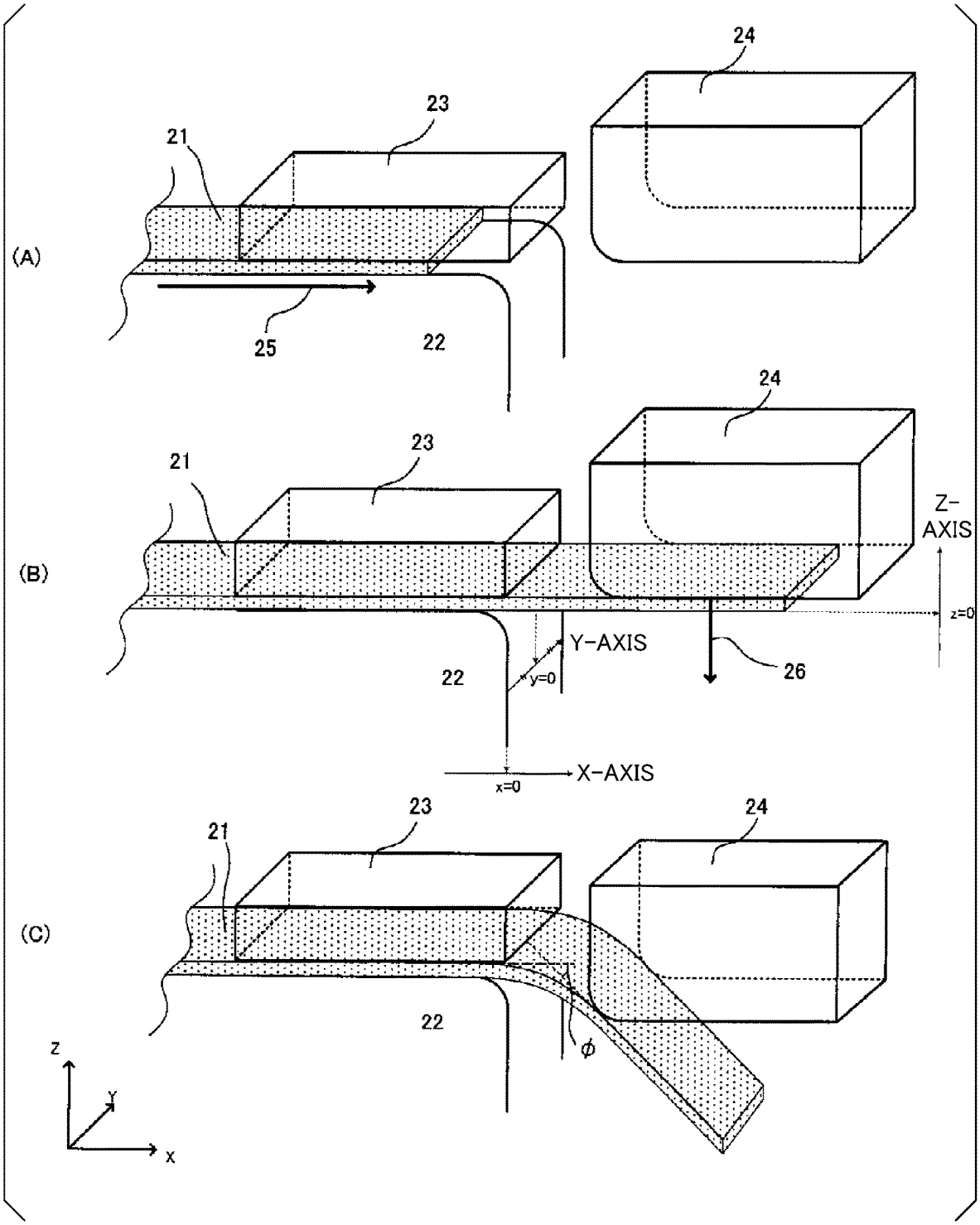
FIG. 12 is an explanatory view showing an example of a bending step in a manufacturing method of a wound core.

The bending method will be described with reference to the drawings. FIG. 12 is an explanatory view showing an example of a bending method of a coated grain-oriented electrical steel sheet in a manufacturing method of a wound core 10.

The configuration of a working machine (hereinafter, also referred to as bending device 20) is not particularly limited, but for example, as shown in (A) of FIG. 12, includes a die 22 and a punch 24 for press working, and also includes a guide 23 for fixing a coated grain-oriented electrical steel sheet 21. The coated grain-oriented electrical steel sheet 21 is conveyed in a conveyance direction 25 and is fixed at a preset position ((B) of FIG. 12). Subsequently, the coated grain-oriented electrical steel sheet 21 is pressed by the punch 24 to a predetermined position in the pressing direction 26 with a predetermined force set in advance, thereby a bent body 1 having a bent region having a desired bending angle φ can be obtained.

—Heating Around Bent Region—

In the manufacturing method of a wound core according to the present disclosure, in the bending step as described above, the temperature of the bent region forming portion of the coated grain-oriented electrical steel sheet is adjusted to an appropriate range. Further, a local temperature gradient at an optional position within a strain affected region in the longitudinal direction is set to an appropriate range. Then, the coated grain-oriented electrical steel sheet is bent and formed into a bent body.

The method of heating the above region is not particularly limited. For example, a method of heating a metal sheet, such as (1) heating in contact with a heated forming tool, (2) heating by holding in a high-temperature furnace, (3) induction heating, (4) energization heating, and (5) heating by irradiation with a high energy ray (for example, infrared rays) such as a halogen heater can be generally applied. The following method is an example of a manufacturing method including this type of heating method. In this method, for example, as in a wound core manufacturing apparatus 40A of a first example shown in FIG. 13, basically, a step of appropriately heating the steel sheet with a heating device 30A (heating furnace) installed immediately before the bending device 20 is included. Further, the method includes a step of conveying the heated steel sheet to the bending device 20 and bending the steel sheet in a high temperature state. That is, the heating device 30A is used to heat not only the bent region forming portion of the grain-oriented electrical steel sheet 21 but also the flat region forming portion adjacent to the bent region forming portion in the longitudinal direction. As a result, the temperature gradient in the strain affected region can be made gentle when the bent region forming portion is bent. However, when the heating-forming tool is used as it is as a processing-forming tool in the method of heating in contact with a forming tool, the procedure corresponding to the conveyance from the heating device 30A to the bending device 20 is omitted.

Figure 13:
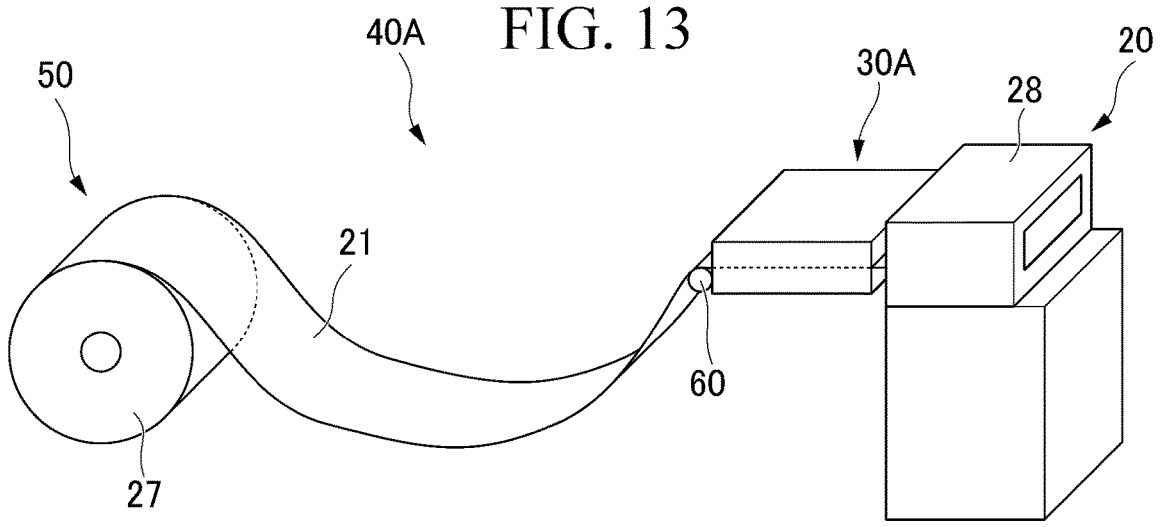
FIG. 13 is an explanatory view showing a first example of a wound core manufacturing apparatus used in a manufacturing method of a wound core.

The manufacturing method of a rolled wound core using a wound core manufacturing apparatus 40A of a wound core of the first example shown in FIG. 13 includes a steel sheet heating step after the steel sheet preparation step and before the bending step. The steel sheet heating step is a step of heating the coated grain-oriented electrical steel sheet 21.

The wound core manufacturing apparatus 40A includes a decoiler 50, a pinch roll 60, a heating device 30A, and a bending device 20.

The decoiler 50 unwinds the coated grain-oriented electrical steel sheet 21 from a coil 27 of the coated grain-oriented electrical steel sheet 21. The coated grain-oriented electrical steel sheet 21 unwound from the decoiler 50 is conveyed toward the heating device 30A and the bending device 20.

The heating device 30A heats the coated grain-oriented electrical steel sheet 21. The coated grain-oriented electrical steel sheet 21 unwound from the coil 27 is conveyed to the heating device 30A. The heating device 30A preferably heats the coated grain-oriented electrical steel sheet 21 by, for example, induction heating or irradiation with high energy rays. Examples of the heating device 30A include heating furnaces such as a so-called induction heating type furnace and an infrared heating type furnace. The heating device 30A heats the coated grain-oriented electrical steel sheet 21 immediately before being conveyed to the bending device 20.

The pinch roll 60 conveys the coated grain-oriented electrical steel sheet 21 to the heating device 30A. The pinch roll 60 adjusts the conveyance direction of the coated grain-oriented electrical steel sheet 21 immediately before being supplied into the heating device 30A. The pinch roll 60 adjusts the conveyance direction of the coated grain-oriented electrical steel sheet 21 in the horizontal direction, and then supplies the coated grain-oriented electrical steel sheet 21 into the heating device 30A. Note that the pinch roll 60 may not be provided.

The bending device 20 bends the coated grain-oriented electrical steel sheet 21 conveyed from the heating device 30A. The bending device 20 includes the die 22, the punch 24, the guide 23, and the cover 28. The cover 28 covers the die 22, the punch 24, and the guide 23. The bending device 20 cuts the coated grain-oriented electrical steel sheet 21 and then bends the coated grain-oriented electrical steel sheet 21. The bending device 20 further includes a cutting machine (not shown) that cuts the coated grain-oriented electrical steel sheet 21 to a predetermined length.

Figure 14:
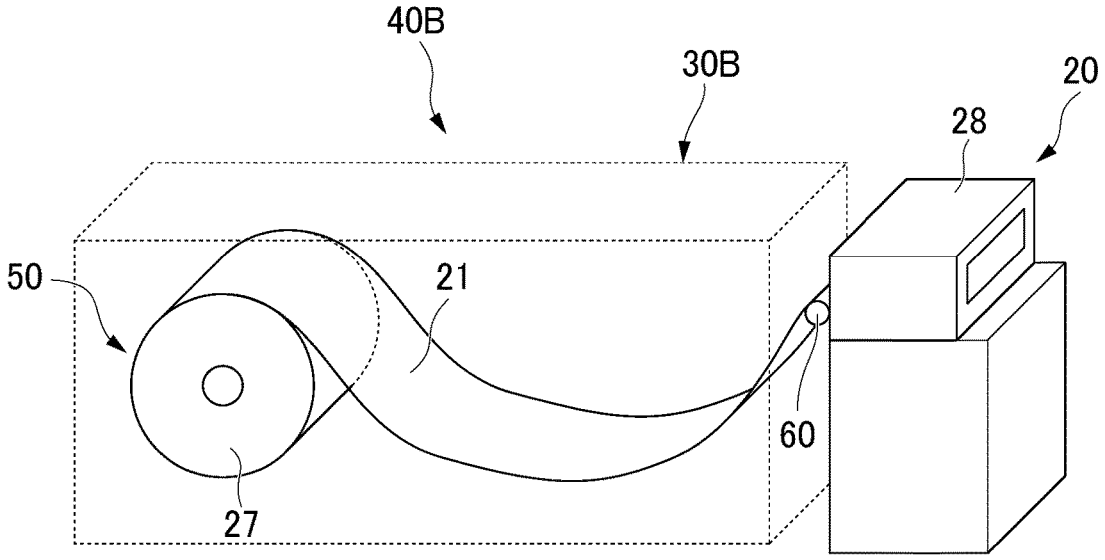
FIG. 14 is an explanatory view showing a second example of a wound core manufacturing apparatus used in a manufacturing method of a wound core.

Note that instead of the wound core manufacturing apparatus 40A according to the first example shown in FIG. 13, a wound core manufacturing apparatus 40B according to a second example shown in FIG. 14 can also be adopted. In the manufacturing apparatus 40B of the second example, a heating device 30B is different from the heating device 30A of the first example. The heating device 30B heats the coil 27 and the coated grain-oriented electrical steel sheet 21 that is unwound from the coil 27 and conveyed to the bending device 20. Note that the heating device 30B does not heat the bending device 20.

According to the wound core manufacturing apparatuses 40A and 40B of the first example and the second example, and the wound core manufacturing methods carried out by the manufacturing apparatuses 40A and 40B, the coated grain-oriented electrical steel sheet 21 is heated before being bent. Therefore, in the coated grain-oriented electrical steel sheet 21, the entire region to be bent can be heated. In other words, not only a portion of the coated grain-oriented electrical steel sheet 21 that comes into contact with the forming tool (die 22 or punch 24) during bending, but also a portion adjacent to the portion of the coated grain-oriented electrical steel sheet 21 that comes into contact with the forming tool can be heated. Therefore, the coated grain-oriented electrical steel sheet 21 can be bent after setting the local temperature gradient at an optional position within the strain affected region in the longitudinal direction as described above, to an appropriate range.

The heating temperature (reached temperature) of the bent region can be controlled by, for example, an output (reactor temperature, current value, and the like) of the heating devices 30A and 30B, the retention time during heating, and the like. Further, the temperature gradient in the strain affected region can be controlled by appropriately fluctuating a heating output itself (that is, a strength of the heating output) or by adjusting the conveyance speed of the steel sheet and the length of the furnace body (soaking area length) to fluctuate a residence time of the steel sheet in the heating devices 30A and 30B. At this time, it is necessary to consider heat conduction from a heated region to a non-heated region. It is natural that these specific conditions differ depending on the steel sheet to be used, the heating devices 30A, 30B, and the like, and it is not intended to uniformly indicate and define the quantitative conditions. Therefore, in the present disclosure, the heating state is defined by a temperature distribution obtained by the temperature measurement described later. However, such control is easy for those skilled in the art who carry out heat treatment of steel sheets as normal work to reproduce a desired temperature state within a practical range according to the steel sheet to be used and the heating devices 30A and 30B, based on measurement data of the steel sheet temperature as described later, and does not hinder the implementation of the wound core and the manufacturing method of the wound core according to the present disclosure.

—Temperature Measurement Around Bent Region—

Here, the temperature of the coated grain-oriented electrical steel sheet in the bending, defined by the present disclosure is measured as follows.

Basically, the temperature is measured in the process of conveying the coated grain-oriented electrical steel sheet from the heating device to the bending device. Specifically, a radiation-type thermometer for measuring minute spots (as an example, TMHX-CSE0500 (H) manufactured by Japan Sensor Co., Ltd.) is installed between the heating device and the bending device, and the thermometer continuously measures the temperature of the coated grain-oriented electrical steel sheet in the longitudinal direction with a response speed of 0.01 s and an accuracy of a region of Φ0.7 mm. At this time, the conveyance speed of the steel sheet and the scanning speed of the measurement spot of the thermometer are adjusted and measured so that a measurement interval in the longitudinal direction of the steel sheet is 0.5 mm (that is, the same as the width of the minute region). From the obtained measured value of the temperature, it is possible to evaluate the heating temperature of the bent region and the temperature gradient of the strain affected region.

At this time, the measurement points at 0.5 mm intervals are set starting from the center of the bent region. When the measurement points are set in order from the center, at the boundary portion between the flat region within the strain affected region and the external region, the temperature gradient may not be determined only at measurement points inside the flat region within the strain affected region. In this case, the temperature gradient shall be determined using the temperature at one measurement point with an interval of 0.5 mm toward the outside of the flat region within the strain affected region. For example, at the boundary portion of the flat region within the strain affected region, the temperature gradient of a region section including the boundary is determined from the temperatures of two points having an interval of 0.5 mm, that is 0.3 mm from the boundary to the inner side and 0.2 mm from the boundary to the outer side.

Note that in the method of using the heating-forming tool as it is as a processing-forming tool, the temperature cannot be measured in the above-described "conveyance process", so that the temperature of the steel sheet immediately after the processing is completed and carried out from the bending device is measured under the same conditions.

—Temperature Control Around Bent Region—

In the manufacturing method of the present disclosure, the temperature of the bent region forming portion of the coated grain-oriented electrical steel sheet is adjusted to 45° C. or higher and 500° C. or lower. It is conceivable that there is a temperature fluctuation in the bent region in the above temperature measurement, but in the present disclosure, the average temperature in the bent region is used. At a temperature of less than 45° C., the generation of deformation twins in the bent region cannot be suppressed. The temperature is preferably 100° C. or higher, and more preferably 150° C. or higher. On the other hand, when the temperature exceeds 500° C., the coating is deteriorated and the laminated steel sheets are welded significantly, and the proper coating tension is lost, resulting in a large decrease in iron loss. The temperature is preferably 400° C. or lower, and more preferably 300° C. or lower. By setting the temperature in the temperature range, it is possible to obtain a known merit of suppressing the generation of deformation twins in the bent region and avoiding deterioration of iron loss in the bent region. Note that a grain-oriented electrical steel sheet, so-called a non-heat resistant magnetic domain control material (ZDKH), in which magnetic domains are refined to reduce iron loss, may lose its magnetic domain control effect when the temperature exceeds 300° C. by the heating. Therefore, when the non-heat resistant magnetic domain control steel sheet is used as the coated grain-oriented electrical steel sheet, it is preferable to control an upper limit of the temperature of the bent region forming portion to 300° C. or lower.

Further, the temperature gradient of the strain affected region in the longitudinal direction of the coated grain-oriented electrical steel sheet is appropriately controlled. Thus, when forming the bent region by heating and bending the steel sheet, it is possible to suppress the peeling of the coating occurring in the flat region existing adjacent to the bent region.

What should be controlled in the present disclosure is the local temperature gradient at an optional position within the strain affected region. In the present disclosure, the temperature distribution at 0.5 mm intervals obtained by the measurement described above is used, and for temperature gradients at 0.5 mm intervals, a maximum value of an absolute value of the temperature gradient (local temperature gradient) is set to less than 400° C./mm. When the maximum value is 400° C./mm or more within the strain affected region, the peeling of the coating due to the temperature gradient becomes remarkable in the flat part. The temperature gradient is preferably less than 350° C./mm, more preferably less than 250° C./mm, still more preferably less than 150° C./mm. Further, the temperature gradient is preferably 3° C./mm or higher, and more preferably 5° C./mm or higher. A preferable range of temperature gradients is set by appropriately combining the preferable upper and lower limits.

Further, the local temperature gradient can be controlled more optimally in consideration of the influence of the sheet thickness of the grain-oriented electrical steel sheet to be applied. In the present disclosure, this is defined as a product of the sheet thickness of the coated grain-oriented electrical steel sheet and the absolute value of the local temperature gradient. When the product is less than 100° C., damage of the coating can be remarkably suppressed. The product is preferably less than 90° C., more preferably less than 60° C., still more preferably less than 40° C. The product is preferably 1° C. or higher, and more preferably 2° C. or higher. A preferable range of the product is set by appropriately combining the preferable upper and lower limit values.

The reason why such control is possible is not clear, but it is thought as follows. It has already been described that the temperature gradient in the present disclosure is a factor for avoiding coating damage associated with the occurrence of strain in the strain affected region. At this time, it is considered that the magnitude of the strain caused by the processing generated in the strain affected region depends on the sheet thickness of the steel sheet to be bent. That is, it is considered that the thicker the sheet thickness, the larger the strain on an outer surface side, particularly in an outermost layer region where the coating is present. Therefore, it is considered that the temperature gradient should be controlled to be lower when the sheet thickness is thicker. The present inventors consider that this point can be defined as the product of the sheet thickness of the coated grain-oriented electrical steel sheet and the absolute value of the local temperature gradient.

Further, when a bent body having two or more bent regions in one corner portion 3 is manufactured like the wound core shown in FIGS. 2 and 3, there may be regions where the strain affected regions for each bent region overlap. When manufacturing a bent body having two or more bent regions in one corner portion 3, bending may be performed so that the temperature gradients in all the strain affected regions including such overlapping region satisfy the above conditions.

(Lamination Step)

A plurality of bent bodies obtained through the above bending step are laminated in the sheet thickness direction so that the coating of each bent body is on the outside. That is, the corner portions 3 of the bent bodies 1 are aligned with each other to be overlapped and laminated in the sheet thickness direction, whereby forming a laminate 2 having a substantially rectangular shape in a side view. As a result, a wound core having a low iron loss according to the present disclosure can be obtained. The obtained wound core may further be fixed using a known binding band or a fastening tool as necessary.

Note that in the above description, the case where four bent bodies 1 are laminated is described, but the number of bent bodies 1 to be laminated is not limited.

Thus, in the wound core according to the present disclosure, in addition to the bent region, in the flat region adjacent to the bent region, peeling of the coating is suppressed, so that iron loss can be reduced. Therefore, according to an embodiment of the present disclosure, the wound core can be suitably used for any of applications known in the related art, such as magnetic cores of transformers, reactors, noise filters, and the like.

The present disclosure is not limited to the above-described embodiment. The embodiment is an example and anything having substantially the same configuration as the technical spirit described in the claims of the present disclosure and exhibiting the same operational effect can be included in the technical scope of the present disclosure.

EXAMPLES

Examples (experimental examples) will be described below, but the wound core and the manufacturing method of the wound core according to the present disclosure are not limited to the following examples. The wound core and the manufacturing method of the wound core according to the present disclosure can adopt various conditions as long as the gist of the present disclosure is not deviated and the object of the present disclosure is achieved. Note that the conditions in the examples shown below are examples of conditions adopted to confirm the feasibility and effect.

[Manufacturing of Wound Core]

A glass coating (thickness of 1.0 μm) containing forsterite ($Mg_2SiO_4$) as a primary coating, and a secondary coating containing aluminum phosphate (thickness of 2.0 μm) were formed in this order on the base steel sheet having the above-described chemical composition. A plurality of coated grain-oriented electrical steel sheets in which magnetic domains are refined by irradiating the surface of the steel sheet with a laser at intervals of 4 mm in the rolling direction in a direction orthogonal to the rolling direction were prepared.

Bending was performed by controlling the bent region forming portion of these coated grain-oriented electrical steel sheets in a temperature range of 25° C. or higher and 600° C. or lower, and controlling the temperature gradient of the strain affected region to obtain a bent body having a bent region.

Table 1 shows the sheet thickness of the steel sheet, the radius of curvature of one bent region, the bending angle of one bent region, the heating temperature of the bent region (local region temperature), and the local temperature gradient.

Note that the steel sheet was heated by an induction heating coil (heating device) installed before the bending device, and after heating, the temperature of the steel sheet was measured by the above-described method in the process of conveying the steel sheet to the bending device.

Figure 15:
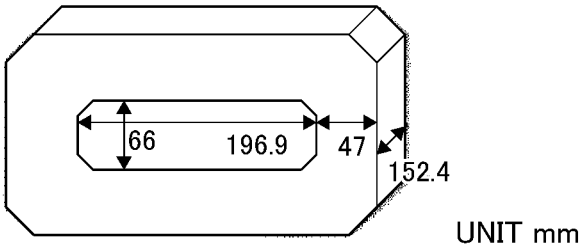
FIG. 15 is an explanatory view showing a dimension of a wound core manufactured by a manufacturing method of FIG. 12.

Next, by laminating the bent bodies in the sheet thickness direction, a wound core having a dimension shown in FIG. 15 was obtained. The number of laminated sheets is 200 for a 0.23 mm steel sheet, 90 for a 0.50 mm steel sheet, 306 for a 0.15 mm steel sheet, and 131 for a 0.35 mm steel sheet, depending on the sheet thickness of the used steel sheet. FIG. 15 shows a wound core having a bending angle of 45° in the bent region (wound core 10 of FIGS. 1 and 2), but in the present example, a wound core having a bending angle of 90° (wound core 10B of FIG. 4) is also manufactured with the same dimension.

Experiment Nos. 1 to 29 are examples of heating so that a gentle temperature gradient is formed over the entire strain affected region. Experiment Nos. 30 to 49 are examples of heating so that the temperature change occurs in a specific region within the strain affected region, that is, the temperature change occurs in the specific region.

[Evaluation]

<Number of Deformation Twins in Bent Region>

As described above, the number of deformation twins was measured by observing the cross section structure.

<Welding of Coating>

The laminated steel sheet of the wound core was peeled off, and the presence or absence of welding of the coating was evaluated on a five-point scale. A proportion of a welded area in the bent part was evaluated as "5" for more than 80%, "4" for 80% or less and more than 60%, "3" for 60% or less and more than 40%, "2" for 40% or less and more than 20%, and "1" for 20% or less.

Note that as an indirect method for evaluating welding, as described in Patent Document 3, a method of measuring an elution P of a steel sheet can be included. However, this time, the welding of the coating of the steel sheet was directly evaluated. The reason is that, as described above, when the strain remains unevenly locally on the coating and the shape of the surface layer of the steel sheet becomes locally rough due to the temperature gradient being too high, it causes welding when the steel sheets are laminated. That is, this is because not only the damage of the coating but also the microscopic shape of the coating affects the welding of the coating, and therefore direct evaluation is preferable as a comprehensive index including these effects.

<Measurement of Coating Soundness Rate>

The surface (outer circumferential surface) of the bent body was photographed with a digital camera (Canon PowerShot SX710 HS (BK)), and the damaged region and the sound region of the coating were determined using the concentration displacement measurement software "Grayval" as described in the above-described <Measurement of Soundness Rate>, and the soundness rate of the coating was obtained.

Specifically, first, five bent bodies were selected from a plurality of bent bodies forming the wound core. As the five bent bodies, five bent bodies arranged at equal intervals in the sheet thickness direction including a bent body located on the outermost side in the sheet thickness direction (lamination direction) and a bent body located on the innermost side were selected. Then, the average brightness BA described in (1) of <Measurement of Soundness Rate> and the average brightness BB described in (2) of <Measurement of Soundness Rate> were obtained for these five bent bodies. Further, as described in (3), images were acquired in all the minute regions in each of the five bent bodies. Then, as described in (4), after measuring the local soundness rate (hereinafter, referred to as "basic local soundness rate") in the image of the minute region acquired in (3), the average local soundness rate (hereinafter, referred to as "average local soundness rate") for all the minute regions was obtained. The total number of basic local soundness rates is five times (for five sheets) the number of minute regions. The total number of average local soundness rates is the total number of minute regions.

Here, Tables 1 and 2 show the first local soundness rate and the second local soundness rate as the soundness rate of the coating.

The first local soundness rate shows the lowest value among all the average local soundness rates. That is, when the first local soundness rate is 90% or more, the average local soundness rate for all the minute regions is 90% or more.

The second local soundness rate shows the lowest value among all the basic local soundness rates. That is, when the second local soundness rate is 50% or more, the basic local soundness rate for all the minute regions is 50% or more.

It should be noted that the soundness rate could not be appropriately measured for some samples with severe welding (indicated by "-" in Tables 1 and 2).

<Measurement of Iron Loss Value of Wound Core>

Regarding each of the wound cores of the experimental examples, measurement in an exciting current method in a measurement method of the magnetic characteristics of a flat rolled magnetic steel strip by an Epstein tester described in JIS C 2550-1 was performed under the conditions of a frequency of 50 Hz and a magnetic flux density of 1.7 T, and the iron loss value WA was obtained.

TABLE 1

| Experiment No. | Sheet thickness (mm) | Radius of curvature (mm) | Bending angle (°) | Bent region temperature (° C.) | Local temperature gradient (° C./mm) | Local temperature gradient × sheet thickness (° C.) |
|---|---|---|---|---|---|---|
| 1 | 0.23 | 1.0 | 45 | 25 | 0 | 0 |
| 2 | 0.23 | 1.0 | 45 | 40 | 2 | 0 |
| 3 | 0.23 | 1.0 | 45 | 50 | 3 | 1 |
| 4 | 0.23 | 1.0 | 45 | 80 | 6 | 1 |
| 5 | 0.23 | 1.0 | 45 | 100 | 9 | 2 |
| 6 | 0.23 | 1.0 | 45 | 150 | 14 | 3 |
| 7 | 0.23 | 1.0 | 45 | 200 | 20 | 5 |
| 8 | 0.23 | 1.0 | 45 | 250 | 26 | 6 |
| 9 | 0.23 | 1.0 | 45 | 500 | 54 | 12 |
| 10 | 0.23 | 1.0 | 45 | 520 | 56 | 13 |
| 11 | 0.23 | 1.0 | 45 | 600 | 65 | 15 |
| 12 | 0.23 | 1.0 | 90 | 25 | 0 | 0 |
| 13 | 0.23 | 1.0 | 90 | 40 | 2 | 0 |
| 14 | 0.23 | 1.0 | 90 | 80 | 7 | 2 |
| 15 | 0.23 | 1.0 | 90 | 100 | 9 | 2 |
| 16 | 0.23 | 1.0 | 90 | 150 | 15 | 3 |
| 17 | 0.23 | 1.0 | 90 | 200 | 21 | 5 |
| 18 | 0.23 | 1.0 | 90 | 400 | 45 | 10 |
| 19 | 0.23 | 1.0 | 90 | 520 | 59 | 14 |
| 20 | 0.23 | 1.0 | 90 | 600 | 68 | 16 |
| 21 | 0.50 | 3.0 | 45 | 25 | 0 | 0 |
| 22 | 0.50 | 3.0 | 45 | 40 | 1 | 0 |
| 23 | 0.50 | 3.0 | 45 | 80 | 3 | 1 |
| 24 | 0.50 | 3.0 | 45 | 100 | 4 | 2 |
| 25 | 0.50 | 3.0 | 45 | 150 | 7 | 3 |
| 26 | 0.50 | 3.0 | 45 | 200 | 9 | 5 |
| 27 | 0.50 | 3.0 | 45 | 400 | 20 | 10 |
| 28 | 0.50 | 3.0 | 45 | 520 | 26 | 13 |
| 29 | 0.50 | 3.0 | 45 | 600 | 31 | 15 |

| Experiment No. | Number of deformation twins (count/mm) | Welding of coating (five-point scale) | First local soundness ratio (%) | Second local soundness ratio | Iron loss $W_A$ (W/kg) | Remarks |
|---|---|---|---|---|---|---|
| 1 | 10 | 1 | 100 | 100 | 0.951 | Comparative Example |
| 2 | 8 | 1 | 100 | 100 | 0.938 | Comparative Example |
| 3 | 5 | 1 | 100 | 100 | 0.861 | Example |
| 4 | 4 | 1 | 100 | 100 | 0.853 | Example |
| 5 | 4 | 1 | 100 | 100 | 0.845 | Example |
| 6 | 4 | 2 | 100 | 100 | 0.845 | Example |
| 7 | 2 | 2 | 100 | 100 | 0.818 | Example |
| 8 | 2 | 1 | 100 | 100 | 0.804 | Example |
| 9 | 0 | 3 | 96 | 90 | 0.779 | Example |
| 10 | 1 | 4 | — | — | 0.922 | Comparative Example |
| 11 | 1 | 5 | — | — | 0.914 | Comparative Example |
| 12 | 12 | 1 | 100 | 100 | 0.959 | Comparative Example |
| 13 | 10 | 1 | 100 | 100 | 0.930 | Comparative Example |
| 14 | 4 | 2 | 100 | 100 | 0.861 | Example |
| 15 | 3 | 1 | 100 | 100 | 0.853 | Example |
| 16 | 2 | 2 | 100 | 100 | 0.845 | Example |
| 17 | 0 | 1 | 100 | 100 | 0.836 | Example |

TABLE 1-continued

| | | | | | | |
|---|---|---|---|---|---|---|
| 18 | 0 | 3 | 98 | 92 | 0.812 | Example |
| 19 | 2 | 4 | — | — | 0.919 | Comparative Example |
| 20 | 2 | 5 | — | — | 0.935 | Comparative Example |
| 21 | 14 | 1 | 100 | 100 | 2.128 | Comparative Example |
| 22 | 8 | 2 | 100 | 100 | 2.072 | Comparative Example |
| 23 | 5 | 1 | 100 | 100 | 1.933 | Example |
| 24 | 4 | 1 | 100 | 100 | 1.943 | Example |
| 25 | 2 | 2 | 100 | 100 | 1.906 | Example |
| 26 | 0 | 1 | 100 | 100 | 1.887 | Example |
| 27 | 3 | 3 | 97 | 90 | 1.906 | Example |
| 28 | 3 | 5 | — | — | 2.055 | Comparative Example |
| 29 | 2 | 5 | — | — | 2.109 | Comparative Example |

TABLE 2

| Experiment No. | Sheet thickness (mm) | Radius of curvature (mm) | Bending angle (°) | Bent region temperature (° C.) | Local temperature gradient (° C./mm) | Local temperature gradient × sheet thickness (° C.) |
|---|---|---|---|---|---|---|
| 30 | 0.23 | 1.0 | 45 | 200 | 50 | 12 |
| 31 | 0.23 | 1.0 | 45 | 200 | 100 | 23 |
| 32 | 0.23 | 1.0 | 45 | 200 | 250 | 58 |
| 33 | 0.23 | 1.0 | 45 | 200 | 350 | 81 |
| 34 | 0.23 | 1.0 | 45 | 300 | 100 | 23 |
| 35 | 0.23 | 1.0 | 45 | 300 | 250 | 58 |
| 36-(a) | 0.23 | 1.0 | 45 | 300 | 300 | 69 |
| 36-(b) | 0.23 | 1.0 | 45 | 300 | 350 | 81 |
| 36 | 0.23 | 1.0 | 45 | 300 | 390 | 90 |
| 37 | 0.23 | 1.0 | 45 | 300 | 410 | 94 |
| 38 | 0.15 | 1.0 | 45 | 300 | 100 | 15 |
| 39 | 0.15 | 1.0 | 45 | 300 | 250 | 38 |
| 40 | 0.15 | 1.0 | 45 | 300 | 390 | 59 |
| 41 | 0.15 | 1.0 | 45 | 300 | 410 | 62 |
| 42 | 0.35 | 1.0 | 45 | 300 | 100 | 35 |
| 43 | 0.35 | 1.0 | 45 | 300 | 250 | 88 |
| 44 | 0.35 | 1.0 | 45 | 300 | 390 | 137 |
| 45 | 0.35 | 1.0 | 45 | 300 | 410 | 144 |
| 46 | 0.50 | 1.0 | 45 | 300 | 100 | 50 |
| 47 | 0.50 | 1.0 | 45 | 300 | 250 | 125 |
| 48-(a) | 0.50 | 1.0 | 45 | 300 | 280 | 140 |
| 48-(b) | 0.50 | 1.0 | 45 | 300 | 350 | 175 |
| 48 | 0.50 | 1.0 | 45 | 300 | 390 | 195 |
| 49 | 0.50 | 1.0 | 45 | 300 | 410 | 205 |

| Experiment No. | Number of deformation twins (count/mm) | Welding of coating (five-point scale) | First local soundness ratio (%) | Second local soundness ratio | Iron loss $W_A$ (W/kg) | Remarks |
|---|---|---|---|---|---|---|
| 30 | 1 | 1 | 100 | 100 | 0.804 | Example |
| 31 | 0 | 1 | 100 | 100 | 0.804 | Example |
| 32 | 0 | 1 | 98 | 90 | 0.828 | Example |
| 33 | 0 | 1 | 100 | 100 | 0.821 | Example |
| 34 | 1 | 1 | 98 | 97 | 0.795 | Example |
| 35 | 0 | 1 | 100 | 100 | 0.810 | Example |
| 36-(a) | 0 | 1 | 94 | 90 | 0.797 | Example |
| 36-(b) | 0 | 1 | 94 | 80 | 0.799 | Example |
| 36 | 0 | 1 | 94 | 70 | 0.802 | Example |
| 37 | 2 | 1 | 70 | 40 | 0.869 | Comparative Example |
| 38 | 0 | 1 | 100 | 100 | 0.480 | Example |
| 39 | 0 | 1 | 100 | 100 | 0.476 | Example |
| 40 | 0 | 1 | 99 | 97 | 0.491 | Example |
| 41 | 1 | 1 | 85 | 55 | 0.530 | Comparative Example |
| 42 | 0 | 1 | 97 | 93 | 1.085 | Example |
| 43 | 2 | 1 | 94 | 92 | 1.112 | Example |
| 44 | 1 | 1 | 92 | 78 | 1.175 | Example |
| 45 | 2 | 1 | 56 | 53 | 1.209 | Comparative Example |
| 46 | 2 | 1 | 95 | 94 | 1.795 | Example |
| 47 | 1 | 2 | 92 | 90 | 1.918 | Example |

TABLE 2-continued

| | | | | | | |
|---|---|---|---|---|---|---|
| 48-(a) | 0 | 1 | 90 | 74 | 1.921 | Example |
| 48-(b) | 0 | 1 | 90 | 65 | 1.922 | Example |
| 48 | 0 | 1 | 90 | 50 | 1.924 | Example |
| 49 | 3 | 2 | 44 | 30 | 1.980 | Comparative Example |

According to the results of Tables 1 and 2, in a wound core using a bent body formed by heating the bent region forming portion to 45° C. or higher and 500° C. or lower and appropriately controlling the temperature gradient in the flat region within the strain affected region, deterioration of iron loss was suppressed. In the evaluation of iron loss, in particular, since the absolute value level of the iron loss significantly differs depending on the difference in steel sheet thickness, it should be noted that comparison should be made within the same sheet thickness condition.

In addition, in Experiment Nos. 34 to 49, comparing the effects of the local temperature gradient on a characteristic change behavior due to the difference in steel sheet thickness, it can be seen that more preferable results can be obtained by appropriately controlling the temperature gradient (local temperature gradient×sheet thickness) in consideration of the sheet thickness.

Furthermore, in Experiment Nos. 36, 36-(a), and 36-(b) and Nos. 48, 48-(a), and 48-(b), comparing the effects of the second local soundness rate on the characteristic change behavior, it can be seen that when the second local soundness rate is 50% or more, 60% or more, 70% or more, 80% or more, and 90% or more, favorable results can be obtained in the order described above.

INDUSTRIAL APPLICABILITY

According to the present disclosure, iron loss is suppressed. Therefore, the industrial applicability is great.

BRIEF DESCRIPTION OF THE REFERENCE SYMBOLS

1, 1*a*: bent body
2: laminate
3: corner portion
4, 4*a*, 4*b*: flat part
5, 5*a*, 5*b*, 5*c*: bent region
6: gap
8: flat region
10: wound core
20: bending device
30A, 30B: heating device
40A, 40B: manufacturing apparatus
21: coated grain-oriented electrical steel sheet
22: die
23: guide
24: punch
25: conveyance direction
26: pressing direction

The invention claimed is:

1. A wound core formed by laminating a plurality of bent bodies obtained by forming a coated grain-oriented electrical steel sheet in which a coating is formed on at least one surface of a grain-oriented electrical steel sheet so that the coating is on an outside, in a sheet thickness direction, wherein the bent body has a bent region obtained by bending the coated grain-oriented electrical steel sheet and a flat region adjacent to the bent region, the number of deformation twins present in the bent region in a side view is five or less per 1 mm of a length of a center line in the sheet thickness direction in the bent region, and when a region extending 40 times a sheet thickness of the coated grain-oriented electrical steel sheet to both sides in a circumferential direction from a center of the bent region on an outer circumferential surface of the bent body is defined as a strain affected region, a proportion of an area where the coating is not damaged at any position along the circumferential direction in the flat region within the strain affected region is 90% or more.

2. The wound core according to claim 1, wherein, when a plurality of minute regions divided by 0.5 mm along the circumferential direction are defined as the strain affected region, the proportion in each of the plurality of minute regions in each of the plurality of bent bodies is defined as a basic local soundness rate, and an average value of the basic local soundness rates in each of the minute regions at the same position in the circumferential direction in different bent bodies is defined as an average local soundness rate, the average local soundness rate is 90% or more in all the minute regions having different positions in the circumferential direction, and all the basic local soundness rates are 50% or more.

3. A manufacturing method of a wound core for manufacturing the wound core according to claim 1 or 2, comprising:

a steel sheet preparation step of preparing the coated grain-oriented electrical steel sheet;

a bending step of bending the coated grain-oriented electrical steel sheet to form the bent body under conditions that a portion of the bent body to be the bent region is heated to 45° C. or higher and 500° C. or lower, and in the flat region within the strain affected region, an absolute value of a local temperature gradient at any position in a longitudinal direction of the coated grain-oriented electrical steel sheet is less than 400° C./mm; and a lamination step of laminating the plurality of the bent bodies in the sheet thickness direction.

4. The manufacturing method of a wound core according to claim 3, wherein, in the bending step, the bending is performed under a condition that a product of a sheet thickness of the coated grain-oriented electrical steel sheet and an absolute value of the local temperature gradient is less than 100° C.

5. The manufacturing method of a wound core according to claims 3 or 4, comprising:

a steel sheet heating step of heating the coated grain-oriented electrical steel sheet after the steel sheet preparation step and before the bending step.

6. A wound core manufacturing apparatus used for executing the manufacturing method of a wound core according to claim 5, comprising:

a heating device that heats the coated grain-oriented electrical steel sheet; and a bending device that bends the coated grain-oriented electrical steel sheet conveyed from the heating device.

7. The wound core manufacturing apparatus according to claim 6, wherein the coated grain-oriented electrical steel sheet unwound from a coil is conveyed to the heating device, and the bending device cuts the coated grain-oriented electrical steel sheet and then bends the cut coated grain-oriented electrical steel sheet.

8. The wound core manufacturing apparatus according to claim 7, further comprising:

a pinch roll that conveys the coated grain-oriented electrical steel sheet to the heating device.

9. The wound core manufacturing apparatus according to claim 6, wherein the heating device heats a coil and the coated grain-oriented electrical steel sheet that is unwound from the coil and conveyed to the bending device.

10. The wound core manufacturing apparatus according to any one of claims 6 to 9, wherein the heating device heats the coated grain-oriented electrical steel sheet by an induction heating or an irradiation with high energy rays.

* * * * *